US005711286A

United States Patent [19]

Petrosyan et al.

[11] Patent Number: 5,711,286

[45] Date of Patent: Jan. 27, 1998

[54] GAS-POWERED REPEATING PISTOL

[75] Inventors: Aleksei Lvovich Petrosyan, Moscow; Aleksei Borisovich Shipachov, Kazan; Andrei Borisovich Kapustin, Tversk Region, all of Russian Federation

[73] Assignee: ANICS Corp., Cleveland, Ohio

[21] Appl. No.: 655,799

[22] Filed: May 31, 1996

[30] Foreign Application Priority Data

| | | | |
|---|---|---|---|
| Jun. 2, 1995 | [RU] | Russian Federation | 95109061 |
| Jun. 2, 1995 | [RU] | Russian Federation | 95109062 |
| Mar. 6, 1996 | [RU] | Russian Federation | PCT/RU96/00052 |

[51] Int. Cl.[6] ..... S41B 11/00

[52] U.S. Cl. ..... 124/73; 124/76; 124/53

[58] Field of Search ..... 124/71, 73, 74, 124/75, 76, 53

[56] References Cited

U.S. PATENT DOCUMENTS

| | | | |
|---|---|---|---|
| 2,293,957 | 8/1942 | Wells | 124/11 |
| 2,566,181 | 8/1951 | Fitch | 124/70 X |
| 2,569,995 | 10/1951 | Kapsa | 124/53 |
| 2,640,476 | 6/1953 | Spink | 124/11 |
| 2,817,328 | 12/1957 | Gale | 124/76 X |
| 2,818,056 | 12/1957 | Martin | 124/76 X |
| 2,881,752 | 4/1959 | Blahnik | 124/11 |
| 2,980,096 | 4/1961 | Merz | 124/11 |
| 3,048,159 | 8/1962 | Kline et al. | 124/51 |
| 3,077,875 | 2/1963 | Kline et al. | 124/11 |
| 3,204,625 | 9/1965 | Shepherd | 124/11 |
| 3,207,143 | 9/1965 | Kline et al. | 124/11 |
| 3,233,600 | 2/1966 | Spack | 124/11 |
| 3,494,344 | 2/1970 | Vadas et al. | 124/11 |
| 3,527,194 | 9/1970 | Vadas et al. | 124/111 |
| 3,572,310 | 3/1971 | Chiba | 124/53 X |
| 4,147,152 | 4/1979 | Fischer et al. | 124/76 |
| 4,422,433 | 12/1983 | Milliman | 124/74 |
| 4,461,110 | 7/1984 | Inderbitzen | 42/66 |
| 4,616,622 | 10/1986 | Milliman | 124/73 |
| 5,160,795 | 11/1992 | Milliman | 42/65 |
| 5,476,087 | 12/1995 | Kunimoto | 124/74 X |
| 5,509,309 | 4/1996 | Poor | 124/76 |

FOREIGN PATENT DOCUMENTS

| | | |
|---|---|---|
| 0625689 | 11/1994 | European Pat. Off. . |
| 02685072 | 12/1991 | France . |
| 3511379 | 2/1986 | Germany . |
| 1774153 | 11/1992 | Russian Federation . |
| 1062205 | 5/1965 | United Kingdom . |
| 2226626 | 11/1989 | United Kingdom . |
| PCT/GB92/00001 | 1/1992 | WIPO . |

*Primary Examiner*—Terry Lee Melius
*Assistant Examiner*—Thomas A. Beach
*Attorney, Agent, or Firm*—David A. Burge

[57] ABSTRACT

A gas-powered pistol has a frame with a forwardly opening barrel passage that extends through much of the length of a barrel portion of the frame wherein a reciprocally movable barrel is housed. Side-by-side magazine and gas supply passages extend from the barrel passage through a grip portion of the frame for receiving therein a reloadable magazine and a replaceable pressurized gas cylinder. The frame is formed from metal that is die-cast about a pre-machined metal insert located at the juncture of the barrel and gas supply passages. The insert provides an inlet into which a seal piercing assembly is threaded for receiving pressurized gas from the gas cylinder, and an outlet into which a valve assembly is threaded that slidably supports the breech end of the barrel. The barrel carries a hammer mass that is engaged by a trigger-mounted sear for moving the barrel forwardly in opposition to the action of a firing spring when the trigger is pulled. The hammer mass carries a depending projection that cooperates with a transversely slidable safety to selectively block movement of the barrel by the trigger. When the sear disengages the hammer mass of the forwardly-moved barrel, the trigger and sear are returned to their normal positions by a return spring, and the barrel is moved rapidly rearwardly by the firing spring to operate the valve assembly to duct a burst of pressurized gas into the barrel to fire a BB pellet.

67 Claims, 11 Drawing Sheets

GAS-POWERED REPEATING PISTOL

BACKGROUND OF THE INVENTION

1. Field of the Invention

The present invention relates to a gas-powered pistol having a reciprocally movable barrel that is cycled forwardly by pulling a trigger, and then moves rapidly rearwardly due to the biasing action of a firing spring, with the momentum of the rearwardly moving barrel being utilized to operate a valve to duct a burst of compressed gas into the breech end region of the barrel to discharge from the barrel a projectile such as a BB pellet that was loaded into the barrel through a bottom opening of the barrel during the barrel's forward stroke. More particularly, the present invention relates to a gas-powered pistol of the type just described that employs a simple complement of operating components that can be manufactured at reasonable cost, that are arranged quite logically to provide ease of assembly and reliability of operation during a lengthy service life, that function smoothly and cooperatively to permit rapid trigger firing of a plurality of BB pellets, and that are well suited for use with a frame that preferably is formed by die-casting metal about a pre-machined insert that is threaded at both ends to receive valve and seal-puncture sub-assemblies, with certain of the operating components also preferably defining a simple carriage-mounted trigger and sear sub-assembly that is easily installed on the frame, and with other operating components preferably defining a removable magazine sub-assembly that not only functions to contain a supply of BB pellets but also to positively feed BB pellets one at a time to a loading station and through the barrel's bottom opening as the barrel concludes its forward stoke.

2. Prior Art

Gas-powered repeating pistols are known that utilize bursts of pressurized gas introduced into breech end regions of barrels for propelling projectiles such as BB pellets through the barrels for discharge from muzzle ends of the barrels. Some prior proposals utilize a reciprocally movable barrel that has a side opening through which a pellet is loaded, with a burst of compressed gas being introduced behind the loaded pellet by a valve that operates when rearward barrel movement takes place under the influence of a firing spring.

While some prior gas-powered pellet pistol proposals provide magazines that are removable for refilling, few provide pellet magazines that are of sufficient size to facilitate their being grasped and positioned with ease while being refilled with a supply of BB pellets. BBs tend to roll about under the influence of gravity and are difficult enough to keep track of without one's also encountering difficulties in grasping and positioning a magazine of tiny size into which the BBs are to be fed.

To the extent that removable, refillable magazines have been proposed for use with gas-powered pellet pistols, few, if any, have a "look and feel" resembling the desirable look and feel of clip-type magazines that are utilized by larger caliber weapons. While law enforcement personnel have often sought, for use in training and practice, high quality BB pellet pistols that have the heft, balance and operational features offered by larger caliber weapons, the need for gas-powered pellet pistols to closely resemble larger caliber weapons so that pellet pistols can be used inexpensively during practice and training by law enforcement personnel has not been satisfactorily addressed by prior proposals.

While some prior proposals have recognized the desirability of housing a compressed gas cylinder in a grip portion of a gas-powered pellet pistol, most have made use of complex trigger mechanisms or other space-consuming components deployed in arrangements that are not well suited to accommodate the positioning of a meaty, refillable, clip-type magazine and a replaceable compressed gas cylinder in side-by-side relationship within the grip of a gas-powered pellet pistol. In fact, very few prior pellet pistol proposals provide compact trigger mechanisms and compact arrangements of other operational components that are well suited for use with a grip-carried, clip-type, removable magazine that is configured to introduce pellets directly into a barrel through a bottom opening of the barrel.

While the desirability of providing gas-powered pellet pistols with a rapid refire and a rapid repeat fire capability has been acknowledged, many prior pellet pistol proposals seek to address this need but neglect to utilize the idea of minimizing cycle time by concurrently carrying out some of the essential operational steps, such as moving a barrel forwardly to compress a firing spring while concurrently feeding a pellet through a loading port of the barrel to position the pellet for firing. Nor have previous proposals made good use of the action of a follower spring of a pellet supply magazine to concurrently perform two functions, namely to feed a supply of pellets toward a loading station while also feeding (in a positive manner that utilizes force provided by the spring rather than mere gravitational force) a pellet directly into the breech of a barrel. In fact, a great many prior proposals provide pellet pistols that are undesirably "orientation sensitive" in that they rely on the force of gravity to effect feeding and/or to maintain critical positioning of a pellet, and may not function at all when held in certain attitudes, such as when the pistol is aimed straight up, aimed straight down, or is aimed horizontally but is held upside down.

While some prior gas-powered pellet pistol proposals make use of magnetic force to position or to retain in position a magnetically susceptible pellet, most pellet pistol proposals that call for the presence of a magnet or that provide for the use of magnetic force 1) require the pellets that they fire to contain ferrous material, and 2) require the presence of one or more magnets among the operating components for proper operation. Not taught by prior proposals is the concept of providing a magnet that is not essential for proper pistol operation in a pistol that can function nicely regardless of whether it is provided with pellets that are attracted by magnetic force—wherein the purpose for the presence of a magnet is simply to optionally enhance firing performance and accuracy of the pistol under limited conditions of use, for example when the pistol is being used during target practice while being aimed to fire generally horizontally wherein the pellets that are being fired are magnetically attractable and are therefore capable of being more optimally positioned by the aid of magnetic force.

Safety concerns encountered with a number of prior proposals frequently stem either 1) from loss of control over one or more pellets that have been or are being fed to a firing position by a feeding mechanism that takes over the feeding of pellets once they discharge from a magazine—whereby the pistol cannot be fully unloaded simply by removing or clearing the magazine; or 2) from inadequate "safety" mechanisms that employ one or more relatively easily broken or easily deformed components, or that function to stop pistol operation by blocking movement of one or more pistol components that are relatively easily broken or easily deformed instead of providing a heavy-duty set of safety components that directly block barrel movement—whereby the operation of the "safety" often can be overpowered or is otherwise found to malperform. Eliminating premature feeding of pellets to firing positions, and providing safety devices that reliably perform their intended functions are two needs that have not always been adequately addressed.

Other drawbacks common to many prior gas-fired pellet pistol proposals include: undue complexity of components leading to high manufacturing costs, assembly difficulties and/or lack of reliability of operation; failure of components to transmit operating forces in a balanced and symmetrical manner leading to undue wear, jamming, and/or a tendency to slow down the operation of the pistol when being rapidly refired or repeatedly fired; and, inefficient use and premature depletion of compressed gas supplies which often has been due to poorly designed valves, to unduly slow valve operation, to poor component arrangements that require the use of too many seals.

SUMMARY OF THE INVENTION

The present invention addresses the foregoing and other needs and drawbacks of the prior art by providing a gas-powered repeating pistol that provides a number of features that can be used individually and in various combinations, and that, in preferred practice are utilized collectively to provide a gas-powered repeating pistol that having a novel form of construction and a simplified, quite logical arrangement of operating components that operate smoothly and well, that can be refired and repeatedly fired quite rapidly, that can be manufactured at reasonable cost, that is especially easy to assemble, and that is rugged and quite capable of performing reliably throughout a lengthy service life.

As will be quickly noted by the reader as this "summary" unfolds, the number of individual features offered by the present invention comprises a relatively lengthy list. Used in combination, these several features cooperate synergistically to provide a much improved gas-powered pistol. Used separately or in limited combination, many of these features also can enhance and improve the gas-powered pellet pistols of other proposals.

In preferred practice, features of the invention are utilized in combination to provide a gas-powered repeating pistol having a reciprocally movable barrel that is cycled forwardly by pulling a trigger, that then is moved rapidly rearwardly due to the action of a firing spring, and that operates a valve at the completion of its rearward stroke to duct a burst of compressed gas into the breech end region of the barrel to propel through the barrel for discharge from the muzzle end of the barrel a projectile such as a BB pellet that was loaded into the barrel during the barrel's forward stroke. This combination of features preferably is implemented by providing the the barrel in an elongate form that carries an enlarged hammer mass at a location approximately mid-way along its length, with a compression coil firing spring surrounding a forward end region of the barrel and engaging a front face of the hammer mass to bias the barrel axially rearwardly; and, with a trigger-mounted sear engaging a rear face of the hammer mass for moving the barrel forwardly in opposition to the action of the firing spring when the trigger is pulled.

The combination of features just described is preferably further enhanced by providing the hammer mass with a depending projection that cooperates with a transversely slidable safety formed from steel and having its opposite end regions Supported in spaced, aligned holes formed through opposite side portions of a metal frame of the pistol, with the depending projection and the safety being operable to selectively permit and prevent reciprocal movement of the barrel either in response to operation of the trigger or due to other stimuli. The sear is configured to disengage from the rear face of the hammer mass when the forwardly-moved barrel reaches the end of its permitted forward range of movement, whereupon 1) the trigger and sear are returned to their normal positions by a return spring, and 2) the barrel is moved rapidly rearwardly by the firing spring to operate the valve assembly to discharge a burst of pressurized gas into the barrel to propel through the barrel a BB pellet that was fed from the magazine through a bottom opening of the barrel before the barrel was released to move rapidly rearwardly.

Another combination of features that embodies another aspect of preferred practice (and that also preferably is used in combination with the features described just above) calls for a pistol frame to have a front-opening barrel passage that extends through much of the length of a barrel portion of the frame for housing the reciprocally movable barrel therein; with side-by-side magazine and gas supply passages extending from the barrel passage through a grip portion of the frame for receiving therein a reloadable magazine and a replaceable pressurized gas cylinder; and, with the side-by-side magazine and gas cylinder being spaced and segregated from each other by an intervening wall of the grip portion of the frame.

Another novel combination of features that embodies still other aspects of preferred practice (which features also are preferably utilized in combination with such features as are described above) calls for the frame of the pistol to be formed from metal that is die-cast about a pre-machined metal insert located at the juncture of the barrel and gas supply passages for providing an inlet into which a seal piercing assembly is threaded for receiving pressurized gas from the gas cylinder, and for providing an outlet into which a valve assembly is threaded that slidably supports the breech end of the movable barrel.

In making optimum use of the just-described relatively inexpensive way of forming the frame of a gas-powered pellet pistol in essentially a one-piece form, a concerted effort is made to minimize the amount of expensive internal machining that needs to be performed to prepare the die-cast frame to receive other components; and, the manner in which other components attach to the die-cast frame places emphasis on the use of sub-assemblies and on the use of well-designed components that require a minimum number of component-to-frame attachments to hold a maximum number of components in place on the frame—whereby very little time and effort ultimately is required to complete the assembly of components onto the frame of the pistol once the various operating components and their sub-assemblies are at hand.

A feature that preferably results from the manufacture of the frame of the pistol using metal die-cast techniques resides in forming both barrel and grip portions of the frame as a single piece, with a cooperative arrangement of interior passages and passage openings being provided wherein the operating components of the pistol are housed and/or are rendered accessible only to the limited extent that is desired. Stated in another way, once the various operating components are installed in and are connected to the frame, the protectively enshrouding frame cooperates with other externally exposed component portions to essentially define a "sealed unit" that is not intended to be opened or disassembled or serviced to any significant degree by end users. The "sealed unit" concept is intended to provide a pistol that holds certain operating components away from customer access, withdrawn from exposure to the elements, and closed off to an extent that will aid in ensuring that these withdrawn-from-view components will function well during a lengthy service life without need for cleaning and lubrication by the end user.

The barrel portion of the die-cast frame has a forwardly opening barrel passage that extends along a "barrel axis" through most of the length of the barrel portion. The grip portion of the die-cast frame defines two side-by-side passages, one being a gas supply passage that extends along a "gas supply axis," the other being a magazine passage that extends along a "magazine axis." The gas supply axis and the magazine axis extend generally in spaced parallel relationship and intersect the barrel axis at spaced locations that are near the breech end of the barrel passage. These three intersecting axes can be thought of as essentially forming the letter "F," wherein the barrel axis constitutes the stem of the "F," the gas supply axis provides the top bar of the "F," and the magazine axis provides the other bar of the "F." The intersection of the "barrel" and "gas supply" axes is where the valve of the pistol is installed—a location where portions of the valve extend about and behind the breech end region of the barrel. The intersection of the "barrel" and "magazine" axes is where a "loading station" is defined by the inserted magazine—to which are fed, in sequence, pellets to be loaded into the barrel at a time just before each is to be fired.

Rather than to require costly internal machining of the frame of the pistol to provide threaded openings and accurately formed communicating passages for the valve assembly and a puncturing unit that extracts pressurized gas from an inserted gas cylinder, the present invention preferably utilizes a pre-machined metal fitting, formed from brass or some other suitable metal, that is positioned as an "insert" in a die-casting mold so that, when metal is introduced into the mold to form the frame of the pistol, it flows about and embeds integrally therein the pre-machined metal fitting. By this arrangement, a need for complex and expensive internal machining of the frame is eliminated, and relatively little work is required to ready a newly molded frame to receive the operating components of the pistol.

By die-casting the frame about a pre-machined fitting that has threaded openings that face into the barrel passage and into the gas supply passage, all that is required to properly install the valve components and seal puncturing components of the pistol is to thread these sub-assemblies into the appropriate threaded openings of the pre-machined fitting. The barrel then is inserted through the front opening of the pistol; a front support for the barrel also is inserted into the front opening and is fastened in place; a block-shaped portion of the hammer mass that carries a depending projection for engaging the safety element is installed after inserting it through an opening formed in the frame for receiving the trigger assembly; and, the safety element and its detent are put in place as the trigger assembly is installed. If the pistol is to be promptly test-fired, the magazine is loaded with pellets, is inserted into the magazine passage, and is snap-latched in place; and, a cylinder of compressed gas is installed in the gas passage, with its seal being punctured as a threaded cover is tightened in place.

In preferred practice, the internal threads that receive the gas passage cover are not formed directly in the die-cast metal that defines the grip portion of the frame, but rather are provided by a sleeve type insert that also is positioned in the mold when the frame is die-cast. This approach permits good, wear-resistant threads to be provided in a steel member of suitable hardness to insure proper function during a lengthy service life.

Turning now to a more complete summary of various features of the invention (many of which—as has been observed previously—can be used individually or in various combinations), a gas-powered repeating pellet pistol that embodies the preferred practice of the present invention utilizes a reciprocally movable barrel that is cycled forwardly and rearwardly to carry out all of the steps that are needed to load and fire a magazine-fed BB pellet, with a burst of compressed gas being introduced into a breech end region of the movable barrel to propel the pellet from the muzzle end of the barrel. At the time when the trigger is pulled, the barrel is at rest in a "normal" position, with its breech end being biased by the action of a firing spring into engagement with a movable member of a valve assembly, with the valve assembly being held "closed" by a valve spring to prevent leakage of pressurized gas contained in a valve chamber located to the rear of the breech end of the barrel, and with a magazine that contains BB pellets defining a loading station located alongside the barrel and spaced a short distance forwardly from the breech end of the barrel.

When the trigger is pulled, a trigger-carried sear engages a hammer mass of the movable barrel to move the barrel forwardly as the trigger pivots rearwardly. The farther the trigger is pulled, the farther the barrel moves forwardly—until a "forwardmost" position of the barrel is reached whereupon the sear pivots out of engagement with the hammer mass. The farther the barrel moves forwardly, the greater the extent to which a firing spring is compressed—until the "forwardmost" position of the barrel is reached, whereupon the disengagement of the sear with the hammer mass releases the barrel to move rapidly rearwardly under the influence of the compressed firing spring.

Loading of a BB pellet into the barrel is advantageously accomplished during the forward cycle of movement of the barrel. A loading port is provided in a bottom sidewall portion of the barrel at a location spaced a short distance forwardly from the breech end of the barrel. When the barrel is moved forwardly from its "normal" position to align the loading port with a loading station that is defined by the magazine, a BB pellet positioned by the magazine at the loading station is caused to move quickly through the loading port into the interior of the breech end region of the barrel.

The force that causes a BB pellet to move from the loading station rapidly through the loading port and into the interior of the barrel is provided by a follower spring of the magazine. The follower spring operates on a movable follower of the magazine to bias the follower in a direction extending generally toward the loading station—which causes BB pellets to be fed through a narrow chamber of the magazine to position pellets one at a time to the loading station, and also causes a pellet that has been positioned at the loading station to be biased into engagement with the outer surface of the barrel. By this arrangement, when the loading port of the barrel aligns briefly with the loading station during the forward cycle of movement of the barrel, a BB pellet positioned at the loading station is caused to pop quickly into the barrel through the loading port, and a "next to be loaded" BB pellet is simultaneously fed to the loading station.

Once the newly loaded pellet reaches the interior of the barrel, it does not linger long in the barrel, for the barrel reaches its "forwardmost" position almost instantly thereafter and begins accelerating rearwardly under the influence of the firing spring. By the time when the rapidly rearwardly moving barrel reaches the barrel's "normal" position, the velocity of the rearwardly moving barrel and its mass (which includes the hammer mass that is carried by the barrel) provides sufficient momentum to cause the impact of the barrel's breech end region with the movable valve member to move the valve member rearwardly in opposition to the action of the valve spring (and in opposition to the action of the pressurized gas on the movable valve member) to briefly open the valve so that a burst of pressurized gas is released quickly into the breech end region of the barrel to propel the loaded BB pellet rapidly forwardly along the length of the barrel and to discharge the rapidly moving pellet from the muzzle end region of the barrel.

The energy expended in opening the valve in opposition to the action of the valve spring and in opposing to the action of pressurized gas on the movable valve member quickly causes the momentum of the rearwardly moving barrel to dissipate, whereupon the barrel is rapidly returned to its "normal" position, with this return movement being due both to the action of the valve spring and the force generated by the pressurized gas acting on the movable valve member.

When the pressure of the gas acting on the valve member is relatively high (as typically will be the case when a newly opened gas cylinder is being used to provide the pressurized gas), the valve member will be forced closed more quickly (thereby cutting off the feed of pressurized gas more quickly) than will be the case when the gas pressure is relatively low (as typically will be the case when the gas cylinder that supplies pressurized gas has been in service for some time and is nearly depleted). Thus, a certain amount of compensation is provided to ensure that each firing of a pellet from the pistol is carried out with about the same amount of energy being imparted to a pellet regardless of whether pellets are being fired with by a quicker burst of higher pressure gas from a nearly full cylinder, or by a slightly longer burst of lower pressure gas from a nearly depleted cylinder.

When the sear releases its engagement with the hammer mass of the reciprocally movable barrel, the trigger is in its "fully operated" position, and the sear underlies the path of movement of the hammer mass so as to be positioned out of the way when the barrel is accelerated rearwardly under the action of the firing spring. To return the trigger and the trigger-carried sear to their normal positions, a return spring is provided that preferably is connected at one end to a carriage that pivotally mounts the trigger, and at the other end to the trigger-carried sear.

In an effort to provide reliable function during a lengthy service life, the trigger is pivotally mounted on an accurately formed carriage that is inserted into an opening defined by the die-cast metal frame; the sear is pin-connected to the trigger on opposite sides of the trigger to provide for a balanced transmission of force from the trigger to the sear which, in turn, utilizes two spaced arms to deliver operating force to the hammer mass of the barrel—with the hammer mass surfaces that are contacted by the sear arms being located at equal distances on opposite sides of the barrel axis so that force that is needed to move the barrel forwardly is applied in an axially balanced manner that will not cause jamming or binding. Moreover, the ranges of movement that must be executed by the various operating components of the pistol during firing of the pistol are kept small. These and other features combine to provide for smooth, reliable, non-binding operation that can be repeated by rapidly pulling the trigger—whereby the pistol can be rapidly re-fired and rapidly repeatedly fired, if desired.

In preferred practice, the reloadable magazine and a replaceable compressed gas cylinder are carried in side-by-side relationship in the grip of the pistol, with a transversely extending wall of the grip segregating the magazine and the gas cylinder. The cylinder is pressed into piercing engagement with a seal puncturing unit when a threaded cover is tightened in place beneath the gas cylinder. The positioning of both a compressed gas cylinder and a pellet feeding magazine within separate bottom opening chambers defined within the grip of the pistol constitutes a convenient and entirely logical arrangement that has been quite well received by those who have used such a pistol. Such an arrangement has advantages in that it permits supplies of both ammunition and compressed gas to be introduced through separate bottom openings formed in the pistol grip without having to reorient the weapon should supplies of ammunition and compressed gas need to be replenished concurrently.

Another feature of preferred practice resides in the use of the magazine to define the loading station of the pistol. By utilizing only the magazine to sequentially position pellets at a magazine-defined loading station, and by utilizing a follower spring of the magazine both to feed pellets sequentially to the loading station and to feed pellets from the loading station through the loading port of the barrel, the pellet positioning system is limited to a small set of magazine-carried components that can, if found to be worn after extensive use, be replaced without requiring the use of tools, simply by replacing the magazine itself.

Another feature of preferred practice resides in the configuration of the weapon's ammunition magazine which, although configured to contain spherical pellet ammunition, employs a generally rectangular cross-section that provides much the same look and feel of clip-type ammunition magazines of larger caliber pistols. The magazine is of sufficient size to be provided not only with an internal spring-biased follower but also with an entirely separate spring-action mechanism that biases upper portions of the magazine into proper position for interacting with a traveling barrel of the weapon for feeding pellets one at a time through a side opening of the barrel during firing of the weapon, with lower portions of the elongate magazine also being configured to cooperate with a releasable spring-biased latch member for reliably retaining the magazine during normal use of the weapon, and for readily releasing the magazine for removal from the pistol grip for reloading.

In preferred practice, the magazine carries three springs that cooperate with several relatively movable magazine components to provide an advantageous set of features. A main housing of the magazine defines a supply chamber wherein a movable follower is biased by a follower spring toward an outlet opening. In opposition to the action of the follower spring, the follower may be moved to and retained in a "loading" position to permit BB pellets to be loaded into the supply chamber through an inlet opening that normally is out of communication with the supply chamber. An outlet spring biases an outlet lever toward a "closed" position to normally prevent BB pellets from being discharged through the outlet opening. When the magazine is properly installed in the pistol, the outlet lever is engaged and moved to its "open" position so that a BB pellet is released to be positioned at the loading station. A foot spring is interposed between the main housing of the magazine and a foot member that is carried on the lower portion of the main housing to bias the foot member downwardly. When the magazine is latched into position in the pistol, the foot member is held upwardly in an out-of-way position at the butt end of the grip. When the magazine is unlatched so that it can be removed from the grip, the foot member snaps downwardly under the influence of the foot spring to provide structure that can be grasped with ease to effect removal of the magazine from the grip of the pistol.

Another feature of preferred practice resides in the type of interaction that takes place between the upper end region of the magazine and other components that interact therewith in a manner that prevents a pellet from being loaded introduced into the barrel at times other than when the trigger is being operated to fire the pistol. While the magazine has a release near its upper end that is operated to release one pellet for placement closely alongside the traveling barrel for immediate loading when the weapon is fired, the magazine retains possession of all of the other unfired rounds so that, if the magazine is removed, all but one of the pellets will be retained by the magazine—and the one pellet that is not retained by the magazine will not be retained by the weapon but rather will drop under the influence of gravity out of the magazine chamber of the pistol grip.

In preferred practice, the operation of the pistol exhibits characteristics that promote safety. No pellet is loaded into the barrel except by action of the trigger, with pellet loading being delayed until the trigger has been pulled through nearly its full range of movement—which should take place only when the pistol is deliberately being fired. While one BB pellet that has been fed to the magazine-defined loading station does normally tend to escape the reach of the outlet lever and will not be held returned to the supply chamber of the magazine if the magazine is withdrawn from the grip of the pistol, the one released BB pellet will drop through the magazine passage and can be caught in one's hand when the magazine is removed, for, withdrawal of the magazine from the pistol grip removes the biasing action of the magazine's follower spring from the one released pellet, and there is nothing left to retain the one released pellet in a position where it will be loaded into the barrel if the trigger should be pulled thereby causing the loading port of the barrel to momentarily open.

Because no round is introduced into the barrel unless and until the trigger is operated to fire the weapon, no round will be fired by the weapon if the weapon is dropped or otherwise somehow impacted in a manner that might tend to cause movement of the barrel relative to the body. Even if dropping of the weapon onto a hard surface should somehow cause enough barrel movement to actuate the gas supply valve to permit a small burst of compressed gas into the breech end region of the barrel, the weapon will fire no projectile, for there will be no round in the barrel to be fired.

A further feature of a pistol that embodies the preferred practice of the present invention resides in the rugged and reliable nature of the weapon's "safety"—which constitutes a sizable metal pin that is carried in a passage that opens through opposite sides of the die cast metal body of the pistol. Not only is the safety formed from metal and positioned in a passage formed through the rugged metal body of the pistol, it is positioned to be engaged by a metal projection that depends from the rugged hammer mass at a location protectively housed within the metal body of the weapon—an arrangement whereby the safety either positions a relatively large diameter formation in the path of the barrel-carried projection to block forward barrel movement (to prevent the pistol from being fired), or that positions a smaller diameter formation alongside the path of the barrel-carried projection so as to pose no obstruction to the firing of the weapon.

A feature of preferred practice resides in arranging the safety so that it does not seek to block movement of the trigger, but rather serves to positively block forward movement of the barrel, whereby, when the safety is "on," cycling of the barrel is prevented regardless of whether the trigger mechanism has been actuated, or has in some way been overpowered, or has failed.

In preferred practice, another feature of safety preferably is provided by selecting the firing spring and the valve spring so that the opposing forces they apply to the movable valve member need to be augmented by a certain level of gas pressure (which also acts on the movable valve member) to normally retain the valve member in its closed position. By this arrangement, a minimum required compressed gas pressure for pistol operation can be set which, if not met by pressurized gas supplied by a depleted gas cylinder, will let the valve open so that whatever may remain in the way of pressurized gas will be exhausted to the atmosphere. This "dumping" of gas that is insufficiently pressurized to assure proper operation of the pistol is a safety feature that aids in preventing "misfirings" of the pistol which might otherwise result due to insufficient gas pressure.

In preferred practice, ferrous-metal containing pellets are utilized with the pistol, and the movable valve member of the pistol utilizes magnetic force in an effort to draw each pellet that is loaded into the chamber toward a stem of the movable valve member so that, when a burst of pressurized gas is delivered through the valve stem, the burst of gas will discharge directly onto the pellet. For this purpose, the valve stem preferably is formed from ferrous metal, and preferably has a small magnet attached thereto—which can be located at any of a number of places including at the rearward end of the movable valve member (situated protectively inside the coils of the valve spring), or at other locations within or extending about the valve stem.

As a practical matter, however, a newly loaded pellet spends only a fraction of a second within the confines of the barrel before being fired; and, this being the case, it is possible that, in some instances, the magnetic-attraction-positioning of a newly loaded pellet may not take place—especially if the barrel is aimed straight downwardly when the pistol is fired, whereupon the force of gravity acts directly in opposition to the force of magnetic attraction exerted on a newly loaded pellet. Thus, while magnetic-attraction-positioning of newly loaded pellets is believed to be desirable and, in preferred practice is intended to take place, this feature is not by any means essential to proper operation of the pistol.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Figure 1:
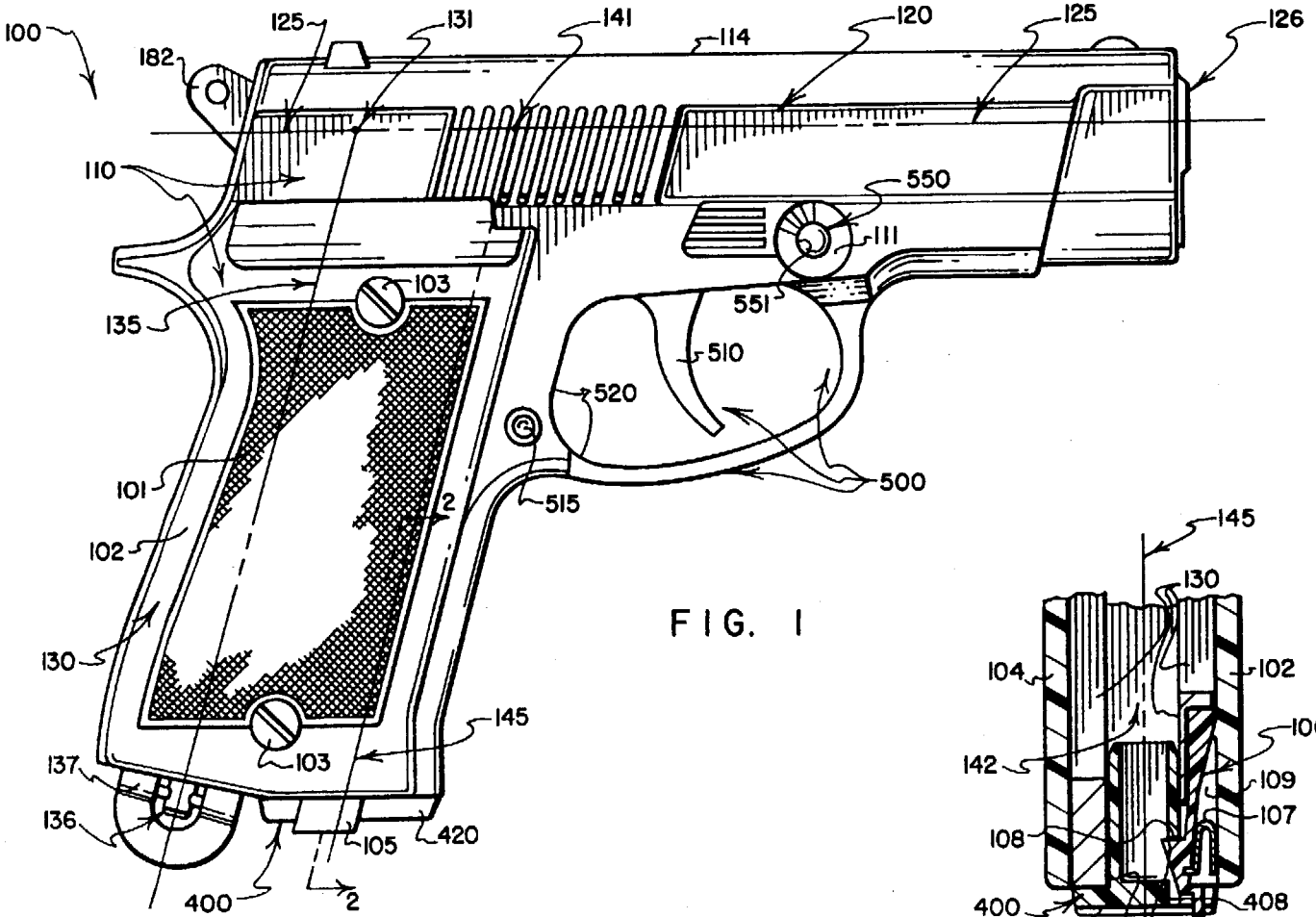
FIG. 1 is a right side elevational view of a gas-powered repeating pellet pistol that embodies the best mode known to the inventors for carrying out the preferred practice of the present invention, with operating components shown in their normal "at-rest" positions.
Figure 3:
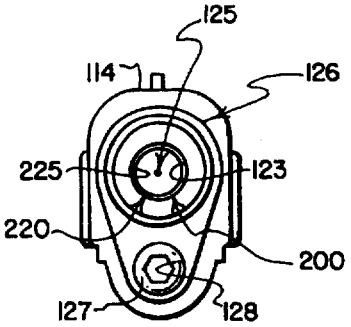
FIG. 3 is a front side elevational view of the muzzle end region of the pistol of FIG. 1.

Referring to FIGS. 1 and 3, a gas-powered repeating pistol that embodies the best mode known to the inventors for carrying out the preferred practice of the present invention is indicated generally by the numeral 100. The pistol 100 has a frame 110 that includes an elongate barrel portion 120 and a grip portion 130. A trigger assembly 500 bridges between the barrel and frame portions 120, 130 of the frame 110, and extends through a frame opening 112 (FIG. 3) into hollow interiors of the barrel and grip portions 120, 130.

Referring to FIG. 1, the external appearance of the right side of the pistol 100 includes a number of features, some of which serve useful purposes, others of which are provided simply to enhance the pistol's external appearance. Many of the surface design elements that are defined by the frame 110 are principally provided for the sake of appearance. Functional elements that contribute to the appearance of the right side of the pistol 100 include a trigger 510 and a trigger guard 520 which are components of the trigger assembly 500; a rounded right end region of a safety 550 that extends into a circular recess 111 defined by the barrel portion 120 of the frame 110; and, a roughened grip surface 101 defined by a right cover plate 102 which is mounted on the grip portion 130 of the frame 110 by screws 103. The grip surface 101 serves to aid one in securely grasping and positioning the pistol 100.

Figure 2:
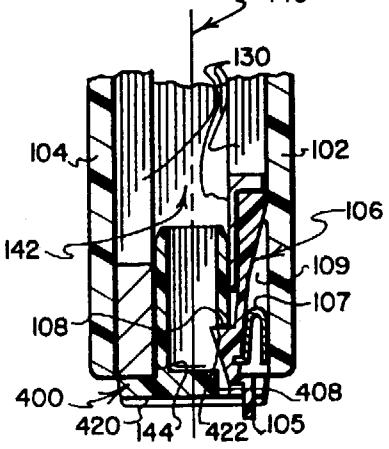
FIG. 2 is a sectional view as seen from a plane indicated by a line 2—2 in FIG. 1 showing a magazine foot latched in a magazine passage of the pistol.
Figure 5:
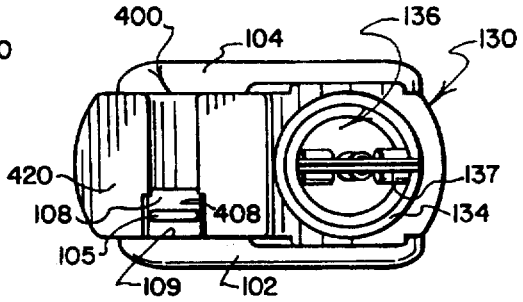
FIG. 5 a bottom view of the butt end region of the grip of the pistol.
Figure 4:
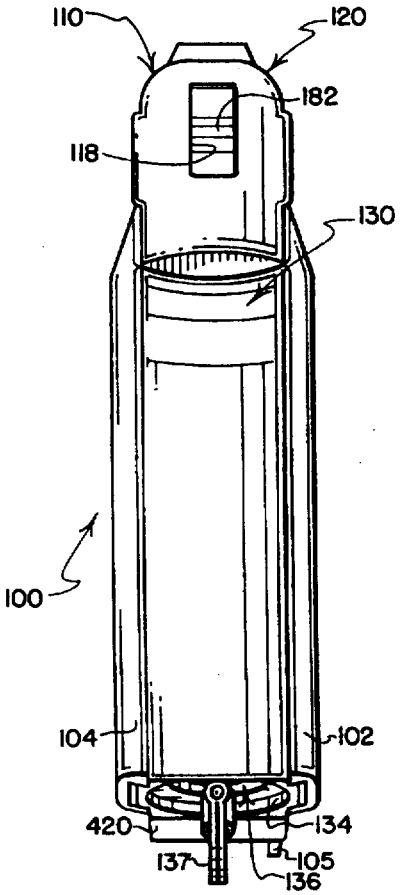
FIG. 4 is a rear side elevational view of the pistol of FIG. 1.

The external appearance of the left side of the pistol 100 is not depicted in the drawings inasmuch as it essentially mirrors the right side appearance that is depicted in FIG. 2. One difference between the right and left sides of the pistol 100 is depicted in FIGS. 3 and 5 wherein it will be noted that a depending tab 105 of a movable latch element 106 and a U-shaped leaf spring 107 for biasing a pawl formation 108 of the latch element 106 (into latching engagement with a notch 408 formed in a right side portion of a magazine foot 420) are carried in a downwardly-opening channel 109 defined between spaced parts of the grip portion 130 and the right cover plate 102. A left cover plate 104 mounted on the left side of the grip portion 130 mirrors the basic configuration of the right cover plate 102 but has no corresponding latch or spring element associated therewith.

Figure 6:
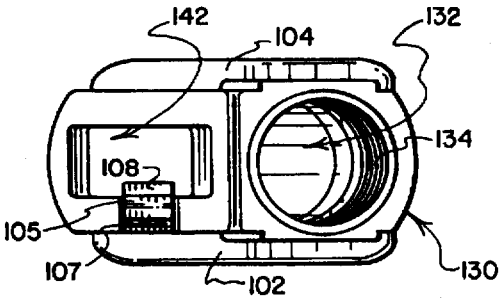
FIG. 6 is a bottom view similar to FIG. 5 but with the pistol's magazine, gas passage cover and gas cylinder removed.

Referring to FIGS. 5 and 6, other functional features of the pistol 100 that contribute to the pistol's external appearance include a plug-like gas passage cover 136 (FIG. 5) that is installed in an internally threaded bottom opening 134 of a gas passage 132 (FIG. 6) at a location near where the magazine foot 420 (FIG. 5) closes a magazine passage 142 (FIG. 6). The gas passage cover 136 carries a hinged, semi-circular shaped handle 137 that can be grasped to facilitate one's rotating the cover 136 to bring external threads 138 (FIG. 3) formed on the cover 136 into and out of engagement with internal threads of the threaded bottom opening 134.

In discussing the pistol's operating components, it is helpful to note that many of the operating components are arranged along one of three axes 125, 135, 145 that extend, respectively, through three frame-defined passages 122, 132, 142. Therefore, as a starting point, reference is made to FIGS. 1, 7, 10 and 14 wherein the axes 125, 135, 145 are depicted, and to FIGS. 7, 10 and 14 wherein the passages 122, 132, 142 and the operating components arranged therein are depicted.

An elongate "barrel passage" 122 extends through much of the length of the elongate barrel portion 120 of the frame 110 and has a forwardly facing opening 124 at the front end of the barrel portion 120. An imaginary "barrel axis" 125 extends through the front opening 124 and within the interior of the barrel passage 122 substantially paralleling a top wall portion 114 of the frame 110. A reciprocally movable barrel 200 extends along the barrel axis 125 and defines a projectile passage 225 that is concentric about the barrel axis 125. The barrel 200 has a breech end region 210, a muzzle end region 220, and a hammer mass 250 which is situated about mid-way along the barrel's length. A firing spring 230 surrounds the muzzle end region 220 of the barrel 200 and has a rear end 232 that engages the hammer mass 250 to bias the barrel 200 rearwardly along the barrel axis 125. When the operating components of the pistol 100 are in their normal "at rest" position, the biasing action of the firing spring 230 holds a rear end 222 of the barrel 200 in engagement with a shoulder 267 (FIG. 15) of an inner valve member 265. A loading port 240 is formed in a bottom portion of the breech end region 210 of the barrel for providing a passage through which a BB pellet 600 may be introduced into the breech end region of the projectile passage 225. The firing spring 230 has a front end 234 that engages a front support member 126 which is installed in the front opening 124 of the barrel portion 120. Upper and lower holes 123, 128 are formed through the front support member 126. The upper hole 123 extends concentrically about the barrel axis 125 and is configured to receive a cylindrical exterior surface 223 of the muzzle end region 220 of the barrel 210 in a smooth slip fit to slidingly support the muzzle end region 220 of the barrel 200 for reciprocal movement along the barrel axis 125. A threaded fastener 127 is installed in the lower hole 128, is threaded into a threaded hole 117 formed in a lower part of the muzzle end region 220 of the barrel portion 120, and is tightened in place to securely mount the front support member 126 on the frame 110. A cylindrical exterior surface 224 of the breech end region 210 of the barrel 200 is received in a slip fit within a bore 258 of an outer valve member 255 to support the breech end region 210 of the barrel for reciprocal movement along the barrel axis 125.

An elongate "gas supply passage" 132 extends through much of the height of the grip portion 130 and has a downwardly facing opening 134 at the bottom or butt end of the grip portion 130. An imaginary "gas supply axis" 135 extends through the bottom opening 134 and centrally through the gas passage 132 in substantially parallel relationship with an interior wall 116 of the frame 110. The gas supply axis 135 intersects the barrel axis 125 at a point indicated by the numeral 131, about which a valve chamber 170 is defined. A replaceable, elongate, pressurized gas cylinder 300 of a conventional, commercially available type normally is carried within a central portion 133 of the gas passage 132, and is positioned such that a cylindrical outer surface 310 of the cylinder 300 extends substantially concentrically about the gas supply axis 135. The gas cylinder 300 has a rounded bottom 330 that is engaged by a conically tapered interior surface 139 (FIG. 10) of the cover 136 so that, when the threaded cover 136 is tightened in place in the threaded bottom opening 134, the cylinder 300 is pressed upwardly in the gas passage 132 to bring a sealed neck 320 of the cylinder 300 into engagement with a seal puncturing assembly 150 located at the upper end of the enlarged chamber diameter 133. When the cover 136 is removed and the bottom opening 134 is oriented to face downwardly, the gas cylinder 300 will drop through the opening 134 and can be caught in one's hand.

An elongate "magazine passage" 142 extends through much of the height of the grip portion 130 and has a downwardly facing opening 144 at the bottom or butt end of the grip portion 130. An imaginary "magazine axis" 145 extends through the bottom opening 144 and centrally through the magazine passage 142 substantially paralleling the interior wall 116 and the gas supply axis 135. The magazine axis 145 intersects the barrel axis 125 at a point indicated by the numeral 141, the vicinity of which is referred to herein as constituting a "loading station" 640 through which location the loading port 240 of the barrel 200 travels when the pistol 100 is fired. A refillable elongate magazine 400 is normally carried in the magazine passage 142. When the pistol 100 is to be fired, the magazine 400 is withdrawn from the magazine passage 142, is filled with a suitable number of conventional, spherical BB pellets 600 (typically having a diameter that is selected to permit the pellets 600 to slide smoothly but not loosely within the diameter of the projectile passage 225, which diameter is typically about 4.25 millimeters, with about eighteen pellets typically filling the magazine 400), whereafter the magazine 400 is reinserted into the magazine passage 142 and functions to feed pellets 600 one at a time to the loading station 640 for being loaded one at a time into the projectile passage 225 through the barrel's loading port 240 during a forward stroke of the barrel 200 at a time just before the barrel 200 executes a very rapid return stroke which results in a loaded pellet 600 being fired from the barrel 200 (as will be explained in greater detail later herein).

Figure 9:
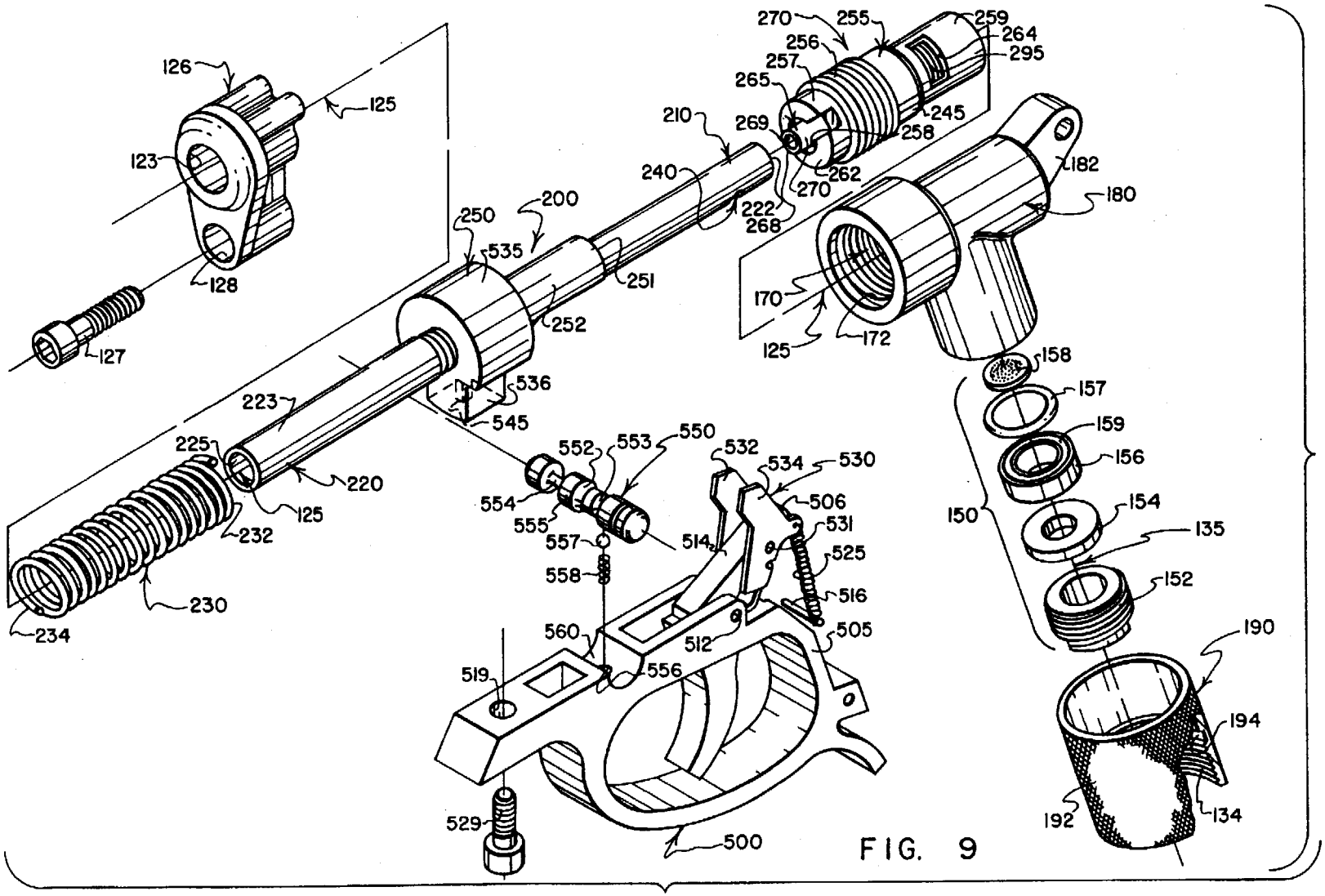
FIG. 9 is an exploded perspective view showing selected components and component sub-assemblies that are connected to various portions of the frame of the pistol when the pistol is assembled, many of which are normally housed within the hollow interior of the frame.
Figure 15:
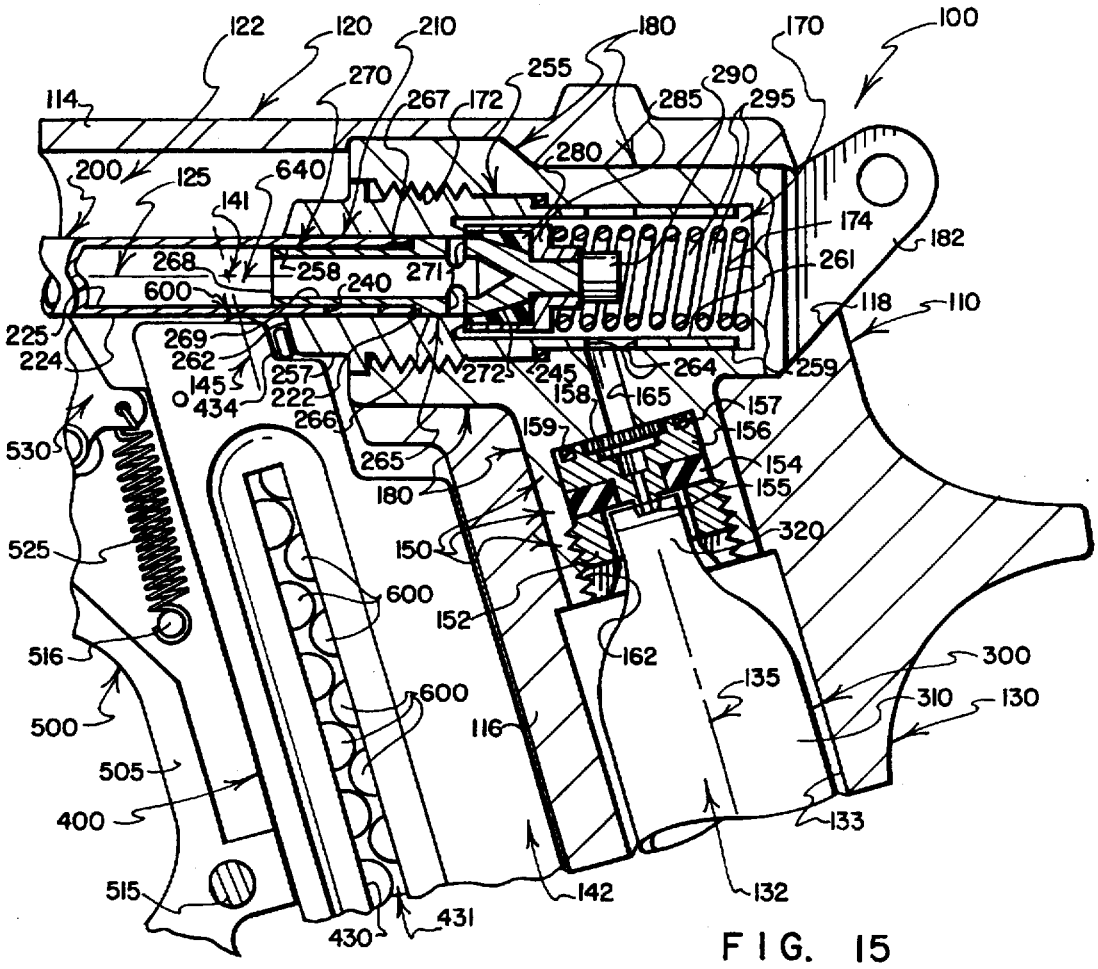
FIG. 15 is an enlargement of a portion of FIG. 7 showing the valve in its closed position.

Referring to FIGS. 9 and 15, the seal puncturing assembly 150 carried in the gas supply passage 132 includes an externally threaded compression ring 152 that is threaded into an internally threaded passage 162. The compression ring 152 compresses an annular seal 154 into engagement with a complexly configured metal disc 156 that defines a piercing needle 155. The piercing needle 155 depends along the gas passage axis 135 for piercing the sealed neck 320 of the gas cylinder 300. An O-ring 157 is carried in an upwardly-opening annular groove 159 of the disc 156. A screen 158 is carried interiorly by the disc 156 to prevent small particles from passing into a small diameter bore 165 that extends concentrically along the gas passage axis 135 and defines the upper end region of the gas passage 132. The small diameter bore 165 ducts pressurized gas from the vicinity of the puncturing assembly 150 into the valve chamber 170.

Referring to FIGS. 9 and 15, a pre-machined fitting 180 is positioned by the frame 110 to extend in the general vicinity of the intersection of the barrel and gas supply axes 125, 135. The threaded, downwardly facing opening 162, the small diameter bore 165, the valve chamber 170, and a threaded, forwardly facing opening 172 (located forwardly along the barrel axis 125 toward the front of the valve chamber 170) all are defined by the fitting 180. The fitting 180 is manufactured before the frame 110 is formed, typically by casting brass or another suitable metal to form the basic shape of the fitting 180, by machining a small portion of the exterior of the cast fitting 180 to define a rearwardly extending projection 182, by machining interior portions of the fitting 180 to form the passage 165 and the valve chamber 170, and by threading interior portions to form the threaded openings 162, 172.

The frame 110 is preferably manufactured from metal, typically an alloy of aluminum, using conventional techniques of die-cast molding. The pre-machined fitting 180 is placed in a suitably configured die-casting mold (not shown) as an "insert," about which metal in heated liquid form is caused to flow to fill the mold whereby much of the exterior of the pre-machined fitting 180 becomes essentially "embedded" in the metal that forms the frame 110. The fitting 180 is, by this technique, rigidly gripped and permanently joined to the metal frame 110 along lines of juncture that are nearly invisible when viewed in cross-section. The only portion of the pre-machined fitting 180 that is visible from the exterior of the pistol 100 is the rearwardly extending projection 182 which passes through and completely seals a rearwardly facing opening 118 of the frame 100.

Referring to FIG. 9, the lower end of the gas supply passage 132 is defined by a sleeve 190 formed from brass or other suitable metal. The sleeve 190 is machined to its final form before the frame 110 is die-cast so that the sleeve 190 and the fitting 180 can both be positioned as "inserts" in a mold (not shown) that is used to die-cast the frame 110. The sleeve 190 has a knurled external surface 192 that is solidly grasped by the metal of the frame 110 during die-casting to securely retain the sleeve 190 so that the sleeve 190 will not come loose even after the cover 136 has been threaded into and out of the bottom opening 134 many times during the service life of the pistol 190. The sleeve 190 can be fabricated from a metal or metal alloy that differs from the metal or metal alloy used to form the frame 110, so that the threaded opening 134 can be formed from stock that will resist wear and that will perform well in conjunction with the plug type cover 136 when the cover 136 is tightened in place to urge the gas cylinder 300 upwardly in the gas passage 132 to cause the piercing assembly 150 to pierce the sealed neck 320 of the cylinder 300 to supply compressed gas through the tubular piercing needle 155 and the passage 165 to the valve chamber 170.

Figure 16:
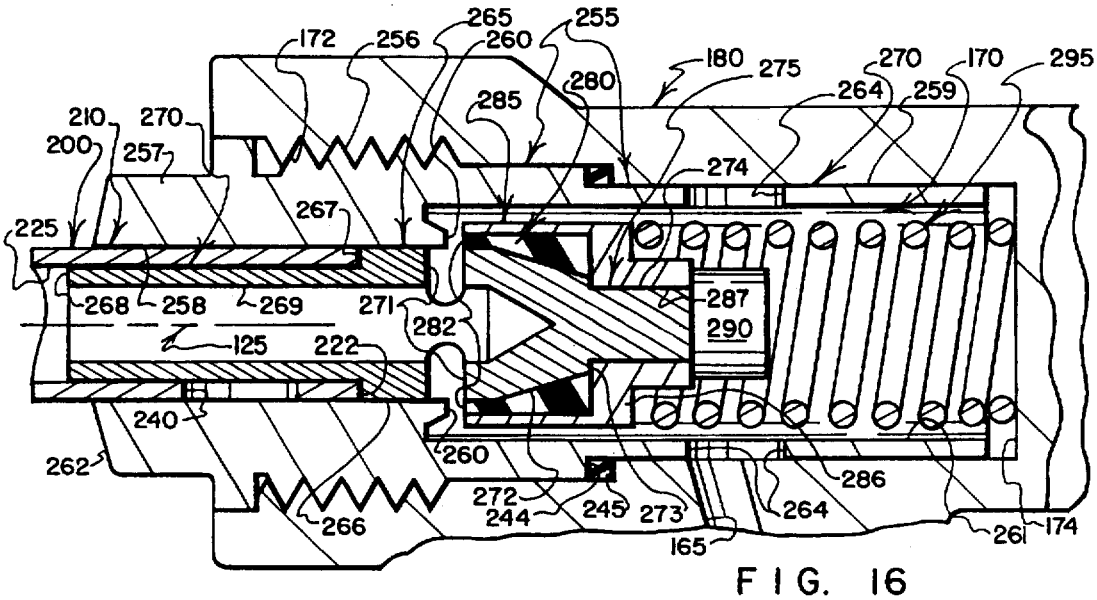
FIG. 16 is a still greater enlargement of a portion of FIG. 14 showing the valve open.
Figure 17:
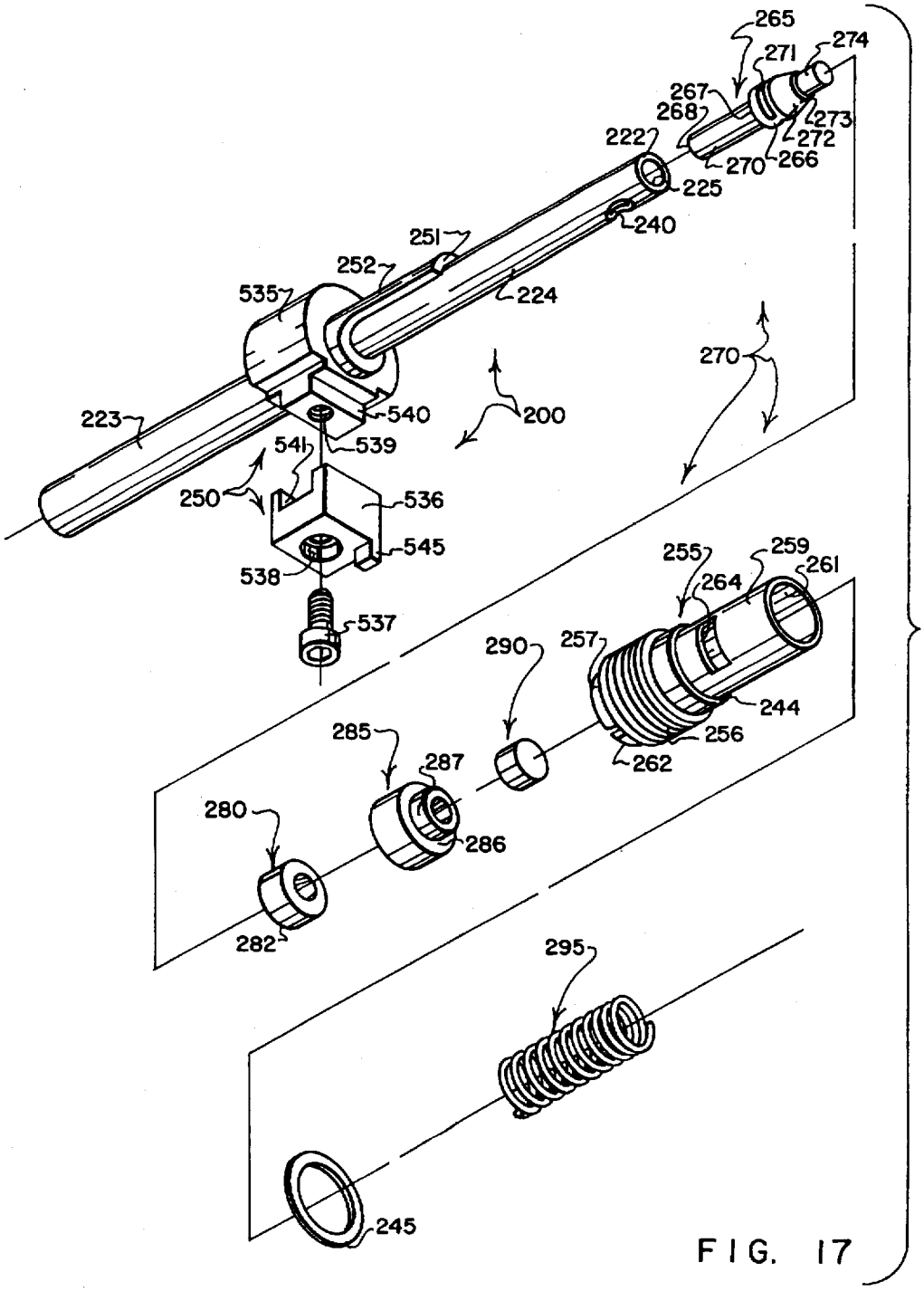
FIG. 17 is an exploded perspective view showing, from a different vantage point than is utilized in FIG. 9, selected components of the pistol that are housed within a barrel passage of the pistol.

Referring to FIGS. 16 and 17, a valve assembly 270 is mounted in the valve chaffer 170 for retaining pressurized gas from the gas cylinder 300 within the valve chamber 170 until a correct moment arrives during the firing of the pistol 100 is being fired when the valve assembly 270 opens to permit a burst of compressed gas to enter the breech end region of the projectile passage 225. The valve assembly includes an outer valve member 255 that internally defines an annular seal engagement surface 260; an inner valve member 265 which has a forwardly projecting stem 270 that extends into the breech end region of the projectile passage 225, and a rearwardly projecting portion 275 that carries an annular seal 280; a sleeve 285 that extends circumferentially about the seal 280; a magnet 290; and, a valve spring 295 that normally biases the seal 280 into seated engagement with the annular seal engagement surface 260.

More particularly, the outer valve member 255 has an externally threaded portion 256 that is threaded into the threaded opening 172 of the fitting 180; a forwardly extending portion 257 that is provided with a bore 258 configured to receive the outer diameter of the breech end region 210 of the barrel 200 in a slip fit so that the barrel 200 can reciprocate axially within the bore 258; a rearwardly extending end region 259 that is provided with a larger diameter bore 261; and, with the annular seal engagement surface 260 being defined internally where a juncture is provided between the different diameter bores 258, 261. A tapered end surface 262 is defined at the forward end of the forwardly extending portion 257. Openings 264 are formed through the rearwardly extending end region 259 (at least one of which aligns with the bore 165 of the fitting 180) to aid the passage of compressed gas from the bore 165 of the fitting 180 into the bore 261 of the outer valve member 255. When the outer valve member 255 is threaded into the fitting opening 172 and is tightened in place, a seal 245 is clamped in place adjacent a shoulder 244 defined on the exterior of the outer valve member 255.

The inner valve member 265 has a relatively large diameter central region 266 which is sized to slip fit within the bore 258 of the outer valve member to mount the inner valve member 265 for reciprocation within the bore 258 of the outer valve member; a forwardly-facing shoulder 267 which forms a transition between the large diameter central region 266 and the smaller diameter forwardly projecting stem 270; a forwardly-facing end surface 268 of the stem 270; an internal bore 269 formed through the stem 270 and through the central region 266; a pair of radially extending passages 271 that communicate at their inner ends with the internal bore 269, and that open outwardly through the exterior surface of the central region 266; and, a truncate-conical portion 272 that, together with a rearwardly facing shoulder 273 form a transition between the large diameter of the central region 266 and the smaller diameter of a rear end region 274 of the inner valve member 265.

The annular seal 280 is configured to fit closely about the truncate-conical portion 272, has a forwardly facing annular seal surface 282, and has a generally cylindrical outer surface that is closely surrounded by the sleeve 285. The sleeve 285 has a radially extending shoulder 286 that has its forward face engaging the shoulder 273 of the inner valve member 265 and engaging the rear end of the seal 280, and that has its rearward face engaged by one end region of the valve spring 295. The sleeve 285 also has a small diameter portion 287 that closely surrounds the rear end region 273 of the inner valve member. The magnet 290 is a generally cylindrical permanent magnet that has one of its flat ends securely bonded to the rear end region 273 of the inner valve member 265. The valve spring 295 extends loosely about the small diameter portion 287 of the sleeve 285, extends loosely about the magnet 290, and extends into engagement with a rear wall 174 of the valve chamber 170.

The valve spring 295 preferably is selected such that it must be assisted by gas pressure of a predetermined minimum magnitude to force the annular seal surface 282 into seated sealing engagement with the annular seal engagement surface 260, for, when the components of the pistol 100 are in their normal "at rest" positions, the firing spring 230 acting on the barrel 200 forces the breech end 222 of the barrel 200 into engagement with the shoulder 267, whereby the inner valve member 265 and the components carried by the inner valve member (including the seal surface 282) are biased rearwardly (i.e., in a direction that tends to separate the valving surfaces 260, 282). Thus, for example, the strengths of the firing and valve springs 230, 295 can be selected so that the rearward biasing action of the firing spring 230 on the barrel slightly overpowers the forward biasing action of the valve spring 295, whereby, in order for the valving surfaces 260, 282 to seat and sealingly engage, gas pressure generated forces acting forwardly on the movable elements of the valve assembly 270 (namely the inner valve member 265 and the components it carries) must be generated by a minimum desired gas pressure (for example a pressure somewhere within the range of about 50 psia or higher) so that enough gas-generated force will be provided to supplement the biasing action of the valve spring 295 to close the valving surfaces 260, 282 into a state of "normally seated and sealed engagement"—which is needed in order for the pistol 100 to be fired.

On the other hand, if this feature (of requiring that a minimum gas pressure be provided in the valve chamber 170 in order for the pistol 100 to be able to operate) is not desired, the strength of the valve spring 295 can be selected so that its normal operation will not need to be supplemented by forces generated due to gas pressure within the valve chamber 170, but with a strength not so great such that the biasing action of the valve spring 295 combined with such valve-closing force as is generated by pressurized gas within the valve chamber are incapable of being overcome by the rearward momentum of the mass of the barrel 200 when the barrel 200 is propelled by the firing spring into impact the shoulder 267 of the inner valve member 265. By adjusting the mass of the hammer mass 250, the rearward barrel momentum needed to effect a desired interval of opening of the valving surfaces 260, 282 can be adjusted to accommodate a wide range of firing spring and valve spring strengths.

When the breech end surface 222 of the barrel 200 impacts the shoulder 267 of the inner valve member 265 with sufficient rearward moving momentum to cause the inner valve member 265 to move rearwardly into the valve chamber 170 a short distance, as illustrated in FIG. 16, the seal surface 282 disengages from the engagement surface 260 to permit compressed gas to flow therebetween, thence into the radially extending passages 271 and into the bore 269 which ducts the gas along the barrel axis 125 through the valve stem 270 for discharge directly into the breech end region of the projectile passage 225. If a pellet 600 is in the breech end region 210 of the barrel 200 when a burst of compressed gas discharges from the bore 269 of the valve stem 270, the pellet 600 will be propelled along the projectile passage 225 for discharge from the muzzle end region 220 of the barrel 200.

Figures 7, 8:
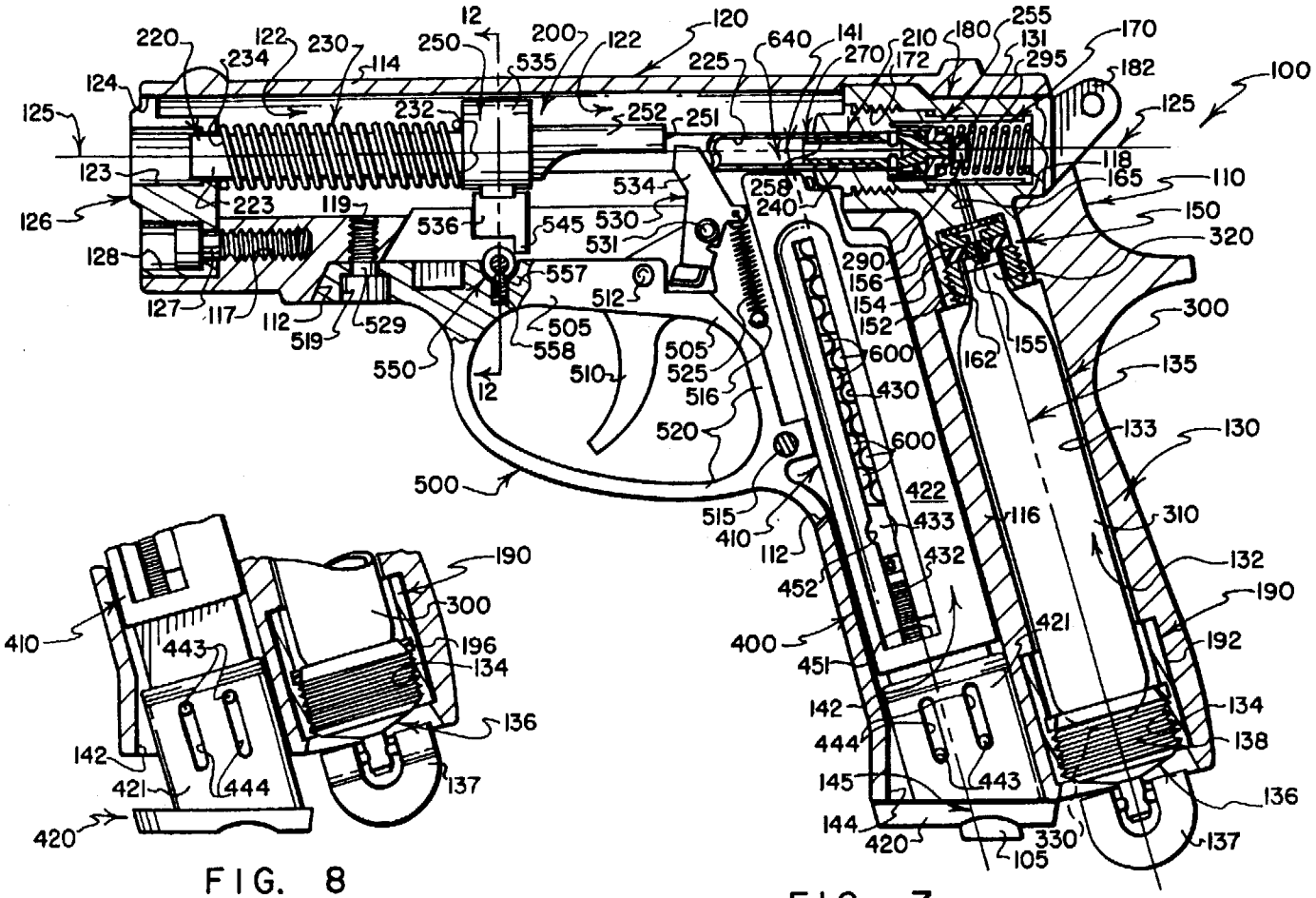
FIG. 7 is a left side elevational view of the pistol with the pistol's operating components positioned as in FIG. 1, with portions of the frame and selected other components broken away and shown in cross-section to permit underlying features to be viewed.
FIG. 8 repeats a portion of the left side elevational view of FIG. 7 but with a foot portion of the magazine of the pistol shown "popped out" to provide a member that can be easily grasped when pulling the magazine out of the pistol's magazine passage.
Figure 10:
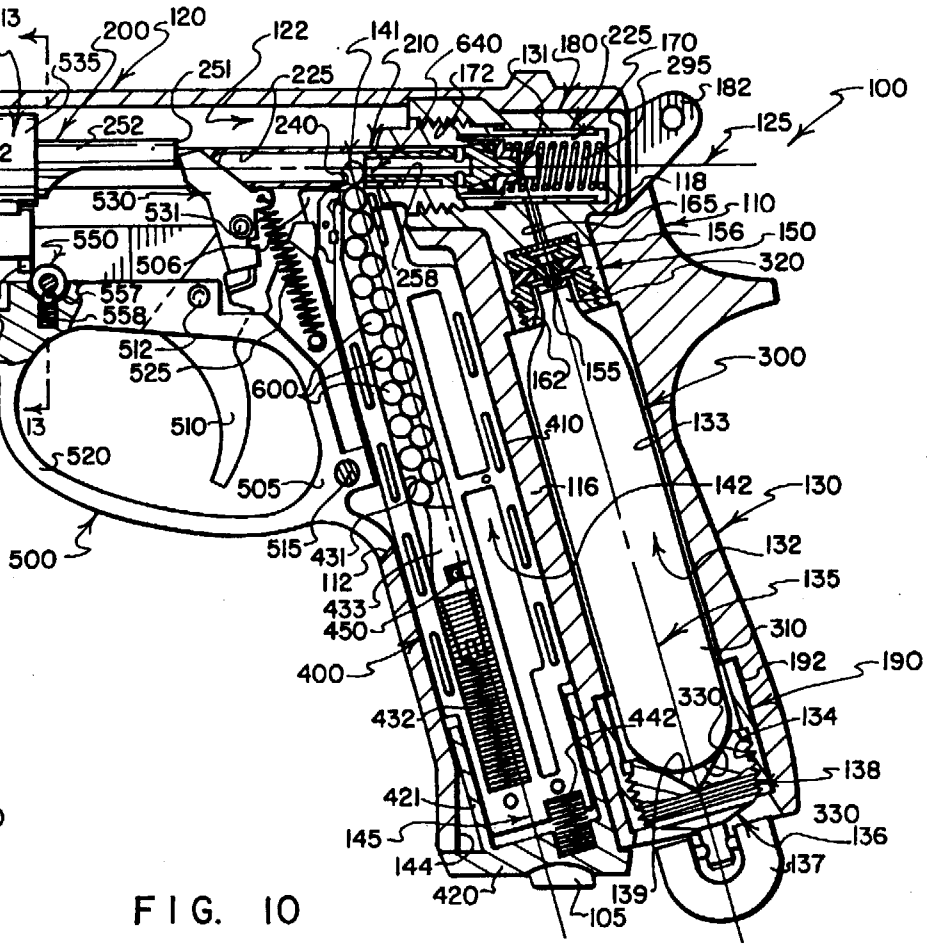
FIG. 10 is a left side elevational view similar to FIG. 7 but with components of the pistol moved to depict their relative positions at a time when the trigger is partially pulled, the barrel has been moved forwardly, and a BB pellet is being loaded into the barrel.
Figure 14:
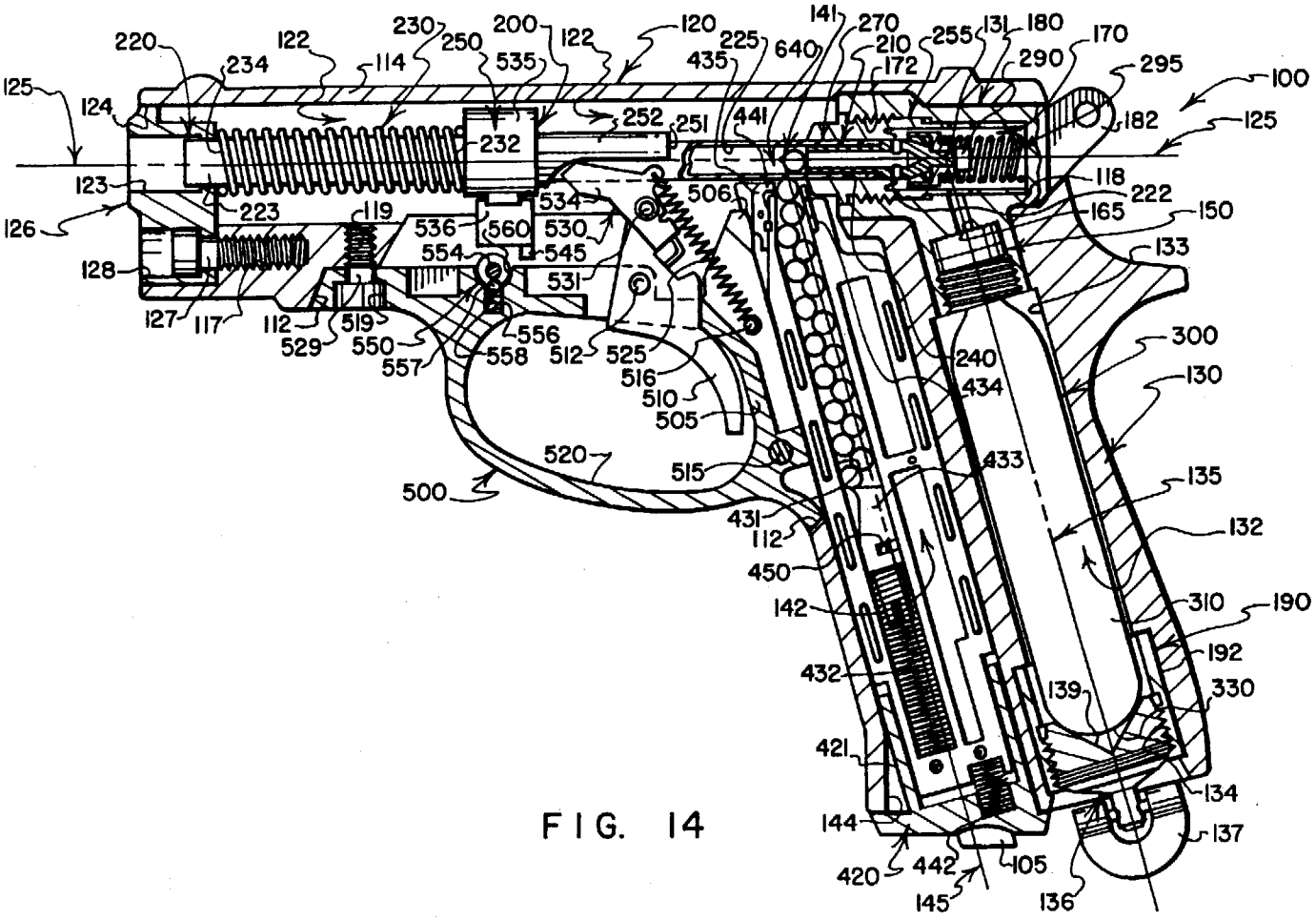
FIG. 14 is a left side elevational view similar to FIG. 10 but with components of the pistol moved to depict their relative positions at an instant in time when the trigger has been fully operated to fire the pistol, and when the barrel has moved rapidly rearwardly and its momentum has been utilized to open a valve to discharge a burst of pressurized gas that has just started to propel a pellet through the barrel.
Figures 18, 19:
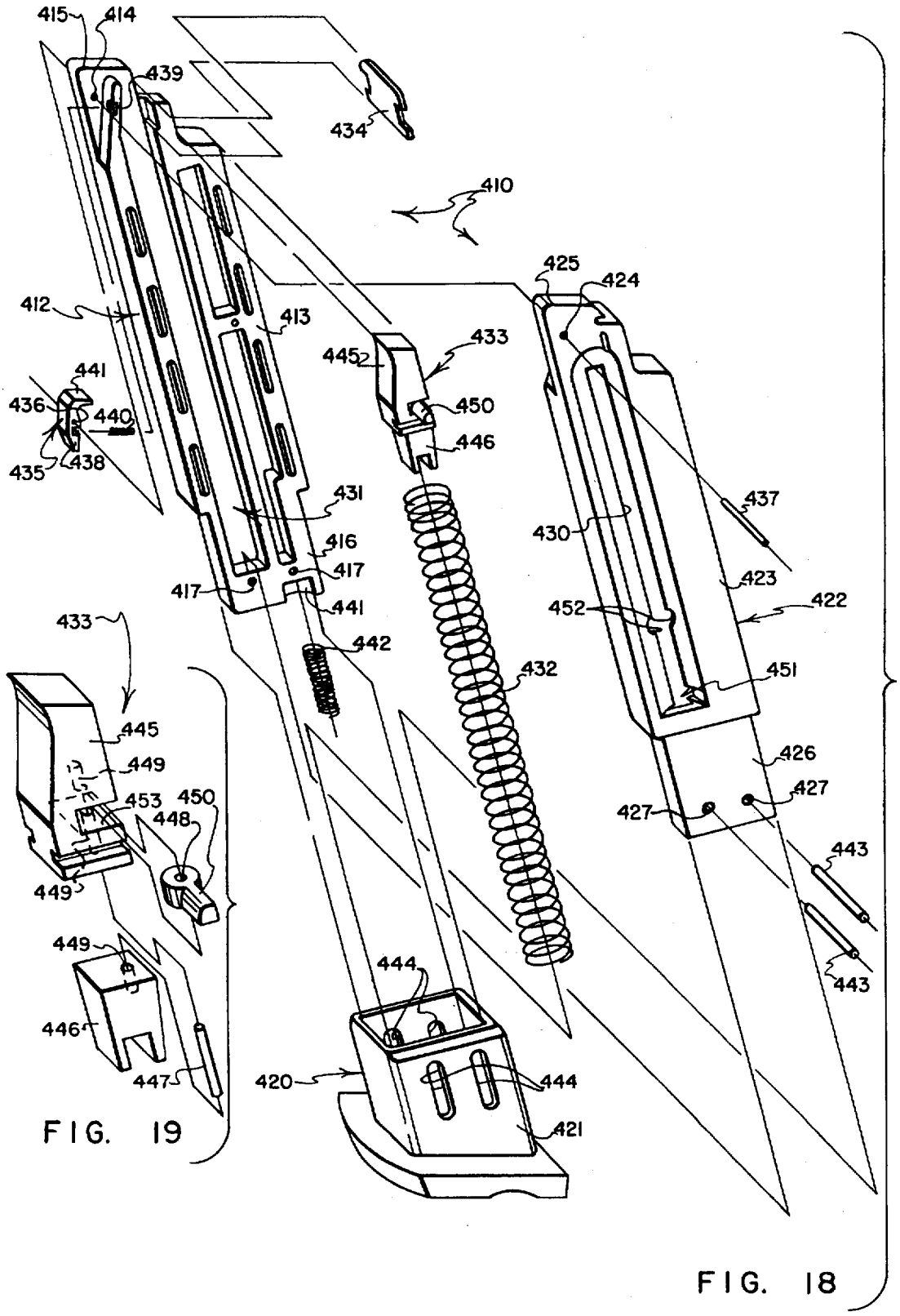
FIG. 18 is an exploded perspective view showing components of the pistol's removable magazine, but with components of a follower shown assembled.
FIG. 19 is an exploded perspective view, on an enlarged scale, showing the components of the follower disassembled; and, FIG. 20 is an exploded perspective view showing components of the trigger assembly of the pistol.

Referring to FIGS. 7, 10 and 14, the magazine 400 is an elongate assembly that is insertable into and removable from the magazine passage 142 through the bottom opening 144. Referring to FIG. 18, the magazine 400 has a main body 410 that is formed when right and left molded plastic housing members 412, 422 that have elongate main body portions 413, 423, respectively, are joined by sonic welding or by other suitable bonding technique. Each of the housing members 412, 422 has a configuration that closely mirrors the configuration of the other—except that the left housing member 422 has a slot 430 formed through and extending along much of the length of its main body portion 423. The slot 430 opens into a main chamber 431 that is cooperatively defined by the housing members 412, 422.

Carried in the main chamber 431 are a follower spring 432 and a follower 433. Located on opposite sides of an upper end region of the main chamber 431 are a metal wear plate 434 and a pivotally movable exit door 435. A mounting hole 436 extends through the exit door 435. A mounting pin 437 extends through the mounting hole 436 and has opposite ends that extend through aligned holes 414, 424 formed in upper end projections 415, 425 of the housing members 412, 422, respectively. Engaging a lower part 438 of the exit door 435 and extending into a recess 439 that is cooperatively defined by the housing members 412, 422 is a compression spring 440. The compression spring 440 biases the exit door 435 toward a closed position wherein a cover projection 441 of the door 435 overlies the upper end of the main chamber 431 sufficiently to ensure that BB pellets 600 that are carried within the main chamber 431 (and that are biased upwardly therein by the action of the follower spring 432 on the follower 433) are retained within the main chamber 431 until the door 435 is deliberately pivoted open by external force.

Figure 11:
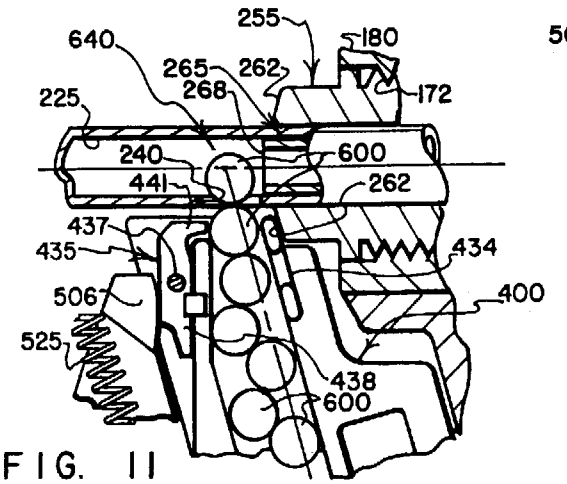
FIG. 11 is an enlargement of a portion of FIG. 10 showing component features within what is referred to as a "loading station" of the pistol.

To open the door 435 at a correct time during final movement of the magazine 400 into its "fully inserted" position within the magazine passage 142 (depicted in FIGS. 7, 10 and 11), a trigger carriage 505 of the trigger assembly 500 (FIG. 9) provides a door engagement formation 506 (FIGS. 11 and 17) that engages the lower part 438 of the exit door 435 to pivot the exit door 435 open in opposition to the biasing action of the door spring 440. Referring to FIG. 11, as the magazine 400 is moved into its fully inserted position, the metal wear plate 434 engages the tapered end surface 262 of the outer valve member 255 to assist in positioning the magazine 400 so that the magazine 400 can perform its several functions which include: 1) determining the exact location along the breech end region 210 of the barrel 200 where the loading station 640 is defined; 2) feeding BB pellets 600 one at a time to the loading station 640; 3) biasing the uppermost of the pellets 600 into engagement with the bottom side of the cylindrical outer surface 224 of the breech end region 210 of the barrel 200 (which takes place when the loading port 240 of the barrel is not at the loading station 640); and, 4) pushing a BB pellet 600 through the loading port 240 of the barrel 200 (which is what happens to a BB pellet 600 that previously has been biased into engagement with the bottom side of the cylindrical outer surface 224 of the breech end region 210 of the barrel 200 at a time when the loading port 240 moves to the loading station 640 during a forward stroke of the barrel 200 caused by the trigger 510 being pulled, as is depicted in FIGS. 10 and 11). When the magazine 400 is in its fully inserted position, the upper end of the magazine 400 is spaced beneath the bottom of the cylindrical outer surface 224 of the barrel 200 by a distance that does not exceed one-fourth of the diameter of the BB pellets 600 that are being fed by the magazine 400 for being loaded into and fired from the barrel 200.

Returning to FIG. 18, the left and right housing members 412, 422 of the magazine 400 have reduced size bottom portions 416, 426 that cooperate to define a downwardly opening chamber 441, into which an upper end region of a foot-biasing spring 442 is carried. A pair of pins 443 extend through aligned holes 417, 427 formed through the bottom portions 416, 426, and have outer end regions that extend into slots 444 defined in opposite sides of a hollow upwardly extending portion 421 of the foot member 420. The hollow portion 421 slidingly receives the reduced size bottom portions 416, 426 of the housing members 412, 422, and pin-and-slot connections defined by the pins 443 and the slots 444 permit the foot member 420 to move upwardly and downwardly a short distance relative to the main housing portion 410 of the magazine 400.

Referring to FIG. 2, when the magazine 400 is to be withdrawn from the magazine passage 142, the latch tab 105 is pressed to release the latching engagement of the pawl 108 from extending into a notch 408 formed in the magazine foot 420, to thereby permit the foot 420 to pop down from the butt end of the grip portion 130 under the influence of the foot spring 442 (as is depicted in FIG. 8) so that the foot member 420 can be firmly grasped to aid in withdrawing the remainder of the magazine 400 from the magazine passage 142.

Referring to FIGS. 18 and 19, the follower 433 is an assembly of an upper part 445, a lower part 446 and a transversely projecting flag 450. The flag 450 is pivotally mounted on a stem 447 that extends through aligned holes 449 formed in the upper and lower parts 445, 446 and through a hole 448 formed through the flag 450. The upper part 445 has a slot 453 that loosely receives the flag 450 so that the flag 450 can be pivoted through a narrow range of movement about the axis of the stem 447.

Referring to FIG. 18, the slot 430 has an L-shaped lower end region 451 into which the flag 450 can be pivoted to hold the follower 433 downwardly within the main chamber 431 in opposition to the action of the follower spring 432 so that pellets 600 can be inserted into the main chamber 431 through a widened loading portion 452 of the slot 430. Once a desired number of pellets 600 has been loaded into the main chamber 431 (usually about eighteen of the pellets 600 are considered to "fill" the main chamber 431), the flag 450 is released from within the L-shaped lower end region 451 so that the follower spring 432 will cause the follower 433 to bias the pellets 600 upwardly in the main chamber 431.

Figure 20:
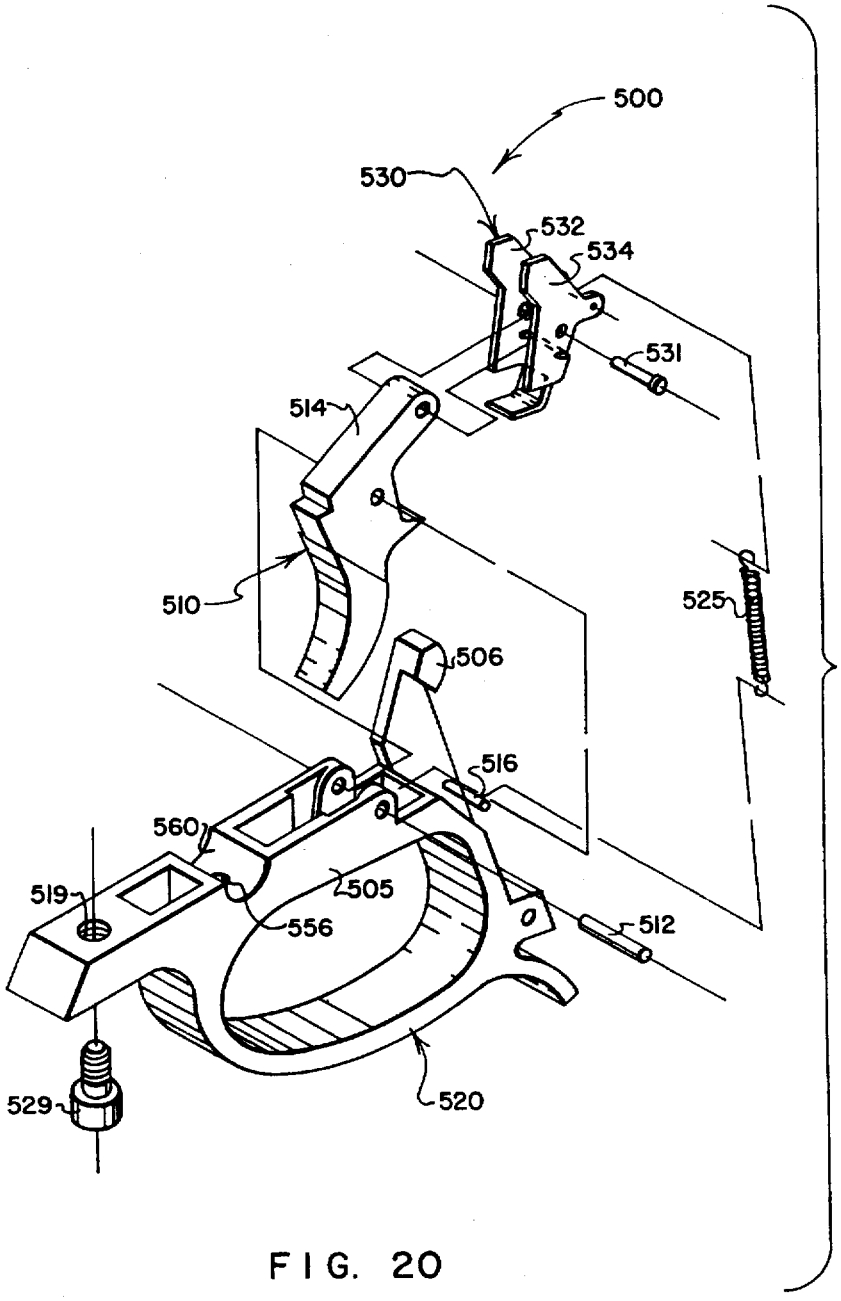

Referring to FIGS. 9 and 20, the trigger assembly 500 includes a carriage 505 on which a trigger lever 510 is pivotally mounted by a pin 512. The trigger assembly 500 also includes a sear 530 that is pivotally mounted by a pin 531 on an upwardly projecting inner end region 514 of the trigger lever 510. The sear 530 has right and left arms 532, 534. A return spring 525 has one end connected to the carriage 505 by a pin 516, and its other end connected to the left arm 534 for biasing both the trigger 510 and the sear 530 toward their normal "at rest" positions (depicted in FIG. 7).

The trigger assembly 500 is connected to the frame 110 by means of a pin 515 and a threaded fastener 529. The pin 515 is pressed through aligned holes formed in the carriage 505 and in the grip portion 130 of the frame 110. The threaded fastener 529 extends through a hole 519 formed in the carriage 505 and is threaded into a threaded hole 119 of the barrel portion 120 of the frame 110.

The sear 530 has right and left arms 532, 534 that are configured to engage portions of a rear face 251 of a rearwardly extending cover portion 252 of the hammer mass 250. The rear face 251 is engaged by the arms 532, 534 at locations equally spaced on opposite sides of the barrel axis 125 to ensure that force applied to the barrel 200 as a result of the trigger's being pulled is applied in a balanced manner tending not to cause binding or excessive wear. When the trigger 510 is pulled to pivot it out of its normal "non-operated" or "at rest" position (depicted in FIGS. 1 and 7) toward its "fully operated" position (depicted in FIG. 14), the right and left arms 532, 534 engage the rear face 251 and cause the barrel 200 to move forwardly along the barrel axis 125 in opposition to the action of the firing spring 230.

As the trigger 510 reaches its fully operated position, the sear arms 532, 534 pivot sufficiently far forwardly and downwardly to disengage the rear face 251 (as depicted in FIG. 14), whereupon the barrel 200 is caused to move rearwardly quite rapidly under the influence of the firing spring 230 to "fire" a pellet 600 from the projectile passage 225 when a burst of pressurized gas is ducted into the breech end region of the projectile passage 225 due to the rear end 222 of the barrel 200 having impacted the shoulder 267 of the inner valve member 265 to separate the valve surfaces 260, 282 (as depicted in FIG. 16) so that compressed gas from the valve chamber 170 is ducted into the projectile passage 225 in the manner that has been described previously. Once the trigger 510 is released (after having been pulled), the return spring 525 pivots both the trigger 510 and the sear 530 back to their "at rest" positions (depicted in FIG. 7).

Referring to FIGS. 9, 12, 13 and 17, the hammer mass 250 includes three elements, namely a relatively large upper member 535 situated at a juncture of the breech and muzzle portions 210, 220 of the barrel 200, a cube-shaped lower member 536, and a threaded fastener 537 which extends through a hole 538 formed in the lower member 536 and is threaded into a hole 539 formed in the upper member 535. The upper member 535 has a size that will permit it to pass easily through the front opening 124 of the barrel portion 120 of the frame 110 during assembly of the pistol 100; and the lower member 536 has a size that permits it to be inserted through the trigger assembly opening 112 of the frame 110 so that the lower member 536 can be connected to the upper member 535 at a time after the upper member 535 (together with the breech and muzzle end regions 210, 220 of the barrel 200) have been inserted through the front opening 124. A depending, generally rectangular formation 540 of the upper member 535 is received in a rectangular, upwardly-opening notch 541 of the lower member 536 to ensure that the lower member 536 is properly located and properly oriented when it is connected to the upper member 535, and to ensure that the lower member 536 does not turn about the axis of the fastener 537 after the upper and lower members 535, 536 have been securely connected by tightening the fastener 537 in place.

Figure 12:
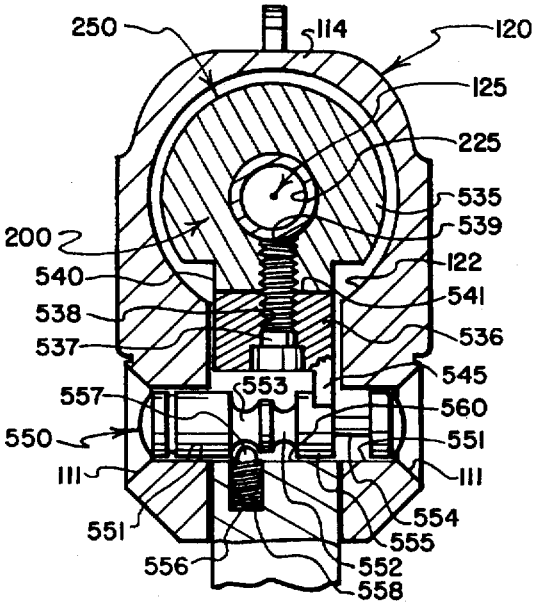
FIG. 12 is a sectional view as seen from a plane indicated by a line 12—12 in FIG. 7, showing the safety of the pistol in a position that blocks reciprocation of the barrel, with a lower portion of the barrel's hammer mass not being shown in cross-section.
Figure 13:
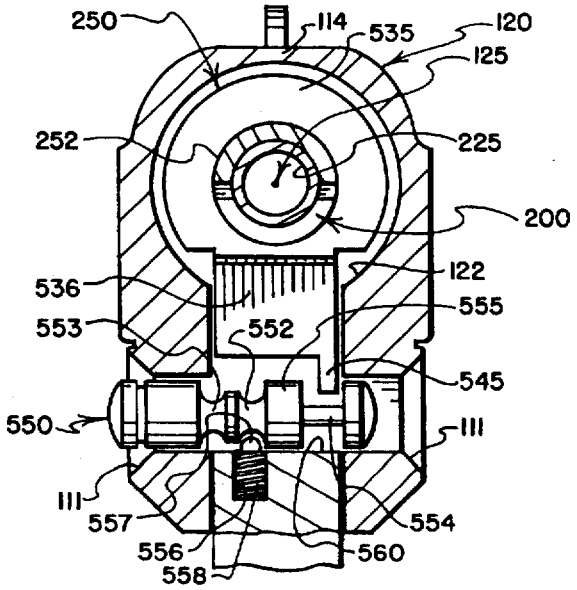
FIG. 13 is a sectional view as seen from a plane indicated by a line 13—13 in FIG. 10, showing the safety of the pistol not blocking barrel reciprocation.

Depending from the lower member 536 (and formed integrally therewith) is a tab-like projection 545 which, normally resides rearwardly with respect to a location where the safety member 550 has its opposite end regions supported in aligned holes 551 that are formed through left and right side portions of the frame 110 (best seen in FIGS. 12 and 13). Recesses 111 are provided by the frame 110 at outer ends of the holes 551. The safety member 550 is slidably movable within the holes 551 between a "safety on" position (depicted in FIGS. 7 and 12) where neither of of the rounded ends of the safety member 550 project very far into either of the recesses 111, and a "safety off" position (depicted in FIGS. 10 and 13) wherein the left rounded end of the safety member projects from the left one of the recesses 111.

Referring to FIGS. 9, 12 and 13, the safety member 550 has two closely spaced round-bottomed grooves 552, 553 located about mid-way along its length; and has a reduced diameter portion 554 that is spaced rightwardly from the location of the grooves 552, 553 by a relatively large diameter portion 555. When the safety member 550 is in its "safety on" position (depicted in FIGS. 7 and 12), the large diameter portion 555 blocks forward movement of the tab-like projection 545—and thereby blocks forward movement along the barrel axis 125 of the barrel 200. When the safety member 550 is in its "safety off" position (depicted in FIGS. 10 and 13), the reduced diameter portion 554 permits forward movement of the tab-like projection 545—and thereby permits forward movement along the barrel axis 125 of the barrel 200.

Referring principally to FIGS. 9, 12 and 13, the trigger carriage 505 defines a semi-circular, upwardly opening recess 560 that closely underlies central portions of the safety member 550. A vertically extending hole 556 (FIG. 14) formed in the carriage 505 opens upwardly into the recess 560. A detent ball 557 and a detent spring 558 are installed in the hole 556. The spring 558 biases the detent ball 557 upwardly 1) to engage the groove 553 when the safety member 550 is in its "safety on" position (depicted in FIGS. 7 and 12), and 2) to engage the groove 552 when the safety member 550 is in its "safety off" position (depicted in FIGS. 10 and 13).

Before turning to a description of the operation of the pistol 100, it is appropriate to point out a few of the features that result from the above-described configuration and arrangement of components. One feature of the preferred practice of the present invention resides in making use of simplified methods of fabrication and assembly that permit the pistol 100 to be manufactured at a reasonable cost. The barrel and grip portions 120, 130 are defined as integral parts of the one-piece frame 110 which is die-cast about the pre-machined fitting 180 and the pre-machined sleeve 190 so that relatively little work needs to be done to put a newly die-cast frame 110 into final form for assembly. During assembly, operating components are attached quickly and easily to the frame 110, with sub-assemblies of many of the operating components (such as the piercing assembly 150 which is threaded i to the opening 162 of the fitting 180, the valve assembly 270 which is threaded into the opening 172 of the fitting 180, and the trigger assembly 500 which is attached to the frame 110 by two fasteners 515, 529) being utilized so that little time and effort needs to be devoted to final assembly. This simplified approach to final assembly permits the more delicate, more precisely formed components of the pistol 100 to be put in place quickly and easily in a manner that tends to avoid component damage, whereby reliability of operation of the resulting product is high.

Other "ease of assembly" features are provided by utilizing the snap-in-place magazine assembly 400 to perform the important function of defining the loading station 640 to which the magazine 400 sequentially feeds a supply of pellets 600; by utilizing quite a simple trigger assembly 500 which delivers operational force to the barrel 200 in a balanced manner by means of two sear arms 532, 534 that engage the hammer mass 550 at locations spaced symmetrically on opposite sides of the barrel axis 125; by utilizing a tubular barrel assembly 200 that (except for the lower member 536 and the threaded fastener 537) can be inserted through the front opening 124 of the barrel portion 120 so that its breech end portion 210 is supported by the valve assembly 270, whereafter the front support member 126 can be installed on the barrel portion 120 by means of the threaded fastener 127 to support the muzzle end region 220 of the barrel assembly 200 for sliding movement within the barrel passage 122; and by using the frame opening 112 to install the lower member 536 onto the upper member 535, and to assemble the safety element 550, the detent 558 and the detent spring 557 as the trigger assembly 500 is moved into position and fastened in position in the frame opening 112.

Before the pistol 100 can be operated it must be provided with a supply of compressed gas, and the magazine must be loaded with BB pellets. However, neither of these activities should be undertaken without first checking to ensure that the safety 550 has been set to the "safety on" position to block reciprocation of the barrel 200.

A supply of pressurized gas is loaded by removing the threaded cover 136 by unthreading it from the threaded opening 134 of the sleeve 190 to provide access to the gas supply chamber 132. A new pressurized gas cylinder 300 is inserted through the opening 134 and into the gas supply chamber 132 to direct the sealed neck 320 of the gas cylinder 300 toward the puncturing assembly 150, whereafter the cover 136 is threaded back into the opening 134. As the cover 136 is tightened into place, it presses upwardly on the rounded bottom end region 330 of the cylinder 300 to cause the sealed neck 320 of the cylinder 300 to be punctured by the needle 155 of the puncturing assembly 150, with a flow of compressed gas being supplied from the cylinder 300 through the narrow passage 165 and into the valve chamber 170, with compressed gas being retained in the valve chamber 170 by the engagement of the seal 280 with the valve surface 260.

A supply of BB pellets 600 is provided to the pistol 100 by removing the magazine 400, by loading the magazine 400, and by reinserting the magazine 400 into the pistol's grip portion 130. Loading of the magazine 400 is begun by moving the follower 433 downwardly until the flag 450 can be pivoted into the transverse leg of the L-shaped lower end region 451 of the slot 430—whereby the follower 433 will be retained in a downward position to permit pellets 600 to be loaded into the chamber 431 through the slot enlargement 452. Once a suitable supply of BB pellets has been loaded into the magazine chamber 431, the follower flag 450 is permitted to slide upwardly in the slot 430 as the follower 433 moves to press the loaded supply of BB pellets 600 upwardly to bring the uppermost of the pellets 600 into engagement with the cover 441 of the exit door 435.

Insertion of the magazine 400 into the magazine passage 142 along the magazine axis 145 brings the wear plate 434 that is carried by the magazine 400 near its upper end into engagement with the tapered forward end 262 of the outer valve member 255; and brings the exit door 435 into engagement with the projection 506 of the trigger carriage 505 to cause the exit door 435 to open so that the uppermost pellet 600 located in the chamber 431 is biased by the follower spring 432 into engagement with the bottom outer surface 224 of the breech end region 220 of the barrel 200. The magazine 400 has been fully inserted when the hollow foot portion 421 is moved into the magazine passage 142 sufficiently for the latch pawl 108 to snap into the notch 408 of the foot 420.

Before the pistol can be fired, the safety 550 must be moved to the "safety off" position so that the hammer-mass-carried projection 545 can pass over the reduced diameter portion 554 of the safety 550. When the trigger 510 is pulled, the trigger-carried sear 530 is caused to engage the end surface 251 and to slide the barrel 200 forwardly. As the loading port 240 passes through the loading station 640, the BB pellet 600 that has been waiting to be loaded pops through the loading port 240 into the projectile passage 225. If the BB pellet 600 is made of iron or has an iron core (which is what is preferred), the newly loaded pellet will be attracted toward the end surface 268 of the valve stem 270 due to magnetization of the inner valve element 265 by the magnet 290 carried at the rear end of the inner valve element 265—which will help to properly position the newly loaded pellet 600 to receive a burst of compressed gas that will be delivered through the bore 269 of the valve stem 270.

Once forward movement of the barrel 200 reaches a point where the sear arms 532, 534 move beneath the cover projection 252 (so as to no longer engage the rear surface 251), the barrel 200 moves rapidly rearwardly to impact the barrel's rear end surface 222 with the shoulder 267 of the inner valve member 265. The rearward moving momentum of the barrel 220 thereby causes the inner valve member 265 to move rearwardly in opposition to the action of the valve spring 290 to separate the valving surfaces 260, 282 so that compressed gas is released from the valve chamber and is ducted into the breech end region of the projectile passage 225 in the manner described in detail previously herein. The rearward momentum of the barrel 200 will be rapidly depleted by the valve spring 295, and the valve spring 295 will cause prompt closure of the valving surfaces 260, 282—so that only enough compressed gas is discharged from the valve chamber to properly propel a loaded pellet 600 from the projectile passage 225. As the valve spring 295 acts to re-engage the valving surfaces 260, 282, the inner valve member 265 moves forwardly, causing corresponding forward movement of the barrel 200—which brings the barrel 200 back to its normal "at rest" position. At the same time that the barrel 200 is executing the movements just described, the return spring 525 has independently caused the sear 530 and the trigger 510 to return to their normal "at rest" positions, to ready the pistol 100 to be re-fired.

The length of time that the valving surfaces 260, 282 remain separated (i.e., the length of time that the valve assembly 270 remains open to permit compressed gas to discharge in a burst from the valve chamber 170) is determined by character of the force that is applied by the valve spring 295 to the inner valve member 265, and by the magnitude of the momentum of the rearwardly moving barrel 220—which, in turn, is determined to at least some degree by the mass of the barrel 200 and by the character of the force that is applied to the barrel 200 by the firing spring 230. Therefore, the selection of the firing and valve springs 230, 295 and the provision of a hammer mass 250 that causes the barrel 200 to present a desired momentum magnitude when operating the valve 270 can be changed to give the pistol 100 slightly differing operating characteristics, as will be readily understood by those who are skilled in the art.

When the pistol 100 is not being fired, the safety member 550 should be moved to its "safety on" position so that the trigger 510 cannot be operated to reciprocate the barrel 200—hence the pistol 100 cannot be operated; and, unless the pistol 100 is to be used quite soon, all pellets 600 should be removed from the pistol 100.

While a variety of "orientation terms" such as "left," "right," "top," "bottom," "upwardly," "downwardly," "forwardly," "rearwardly," "leftwardly," "rightwardly," "inwardly," "outwardly" and the like are used in this document, these terms should not be interpreted as being limiting. The pistol 100 can be oriented in any desired attitude and fired with accuracy, for the force of gravity is not relied on to effect the feeding of pellets 600 into the barrel 200, nor is correct firing of pellets 600 from the barrel 200 dependent on pistol orientation.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the claims, such features of patentable novelty exist in the invention.

What is claimed is:

1. A gas-powered gun, comprising:

a) frame means for defining 1) an elongate barrel passage having a rear end region and having a front end region that defines a front opening, 2) an elongate gas supply passage having one end that communicates with the rear end region of the barrel passage, having an opposite end that is configured to receive a removable gas passage cover, and having a central portion that is configured to receive a cylinder of compressed gas that can be inserted therein when the cover is removed, and 3) an elongate magazine passage that extends side-by-side with the gas supply passage and intersects with the barrel passage at a loading station that is spaced forwardly along the barrel passage from the rear end region of the barrel passage;

b) valve means disposed in the rear end region of the barrel passage for receiving pressurized gas from the cylinder of compressed gas carried in the central portion of the gas supply passage and for dispensing a burst of compressed gas when a forwardly-biased movable valve member of the valve means is briefly moved rearwardly a short distance;

c) barrel means including an elongate barrel extending through the barrel passage and being reciprocally movable therein for defining a projectile passage that extends from a muzzle end region of the barrel through a central region of the barrel to a breech end region of the barrel, with the muzzle end region being slidingly connected to the frame near the front opening of the barrel passage, with the breech end region being slidingly connected to the valve means and being configured to receive within a breech end region of the projectile passage gas that is dispensed in a burst by the valve means, with the central region defining a hammer mass that extends circumferentially about the projectile passage, with a loading port that communicates with the projectile passage and that faces toward the magazine passage being defined through a thin bottom wall portion of the breech end region of the barrel, with the barrel being reciprocally movable relative to the frame means to permit the loading port to move in forward and rearward directions through the loading station, and with the barrel being biased rearwardly into engagement with the movable valve member toward a position wherein the loading port is located rearwardly with respect to the loading station;

d) trigger means carried by the frame means and being engageable with the barrel means for being operated to move the rearwardly-biased barrel forwardly a sufficient distance to move the loading port through the loading station, and for thereafter releasing the rearwardly-biased barrel to travel rearwardly to impact the forwardly-biased movable valve member to move the movable valve member briefly rearwardly to cause a burst of pressurized gas to be dispensed into the breech end region of the projectile passage; and, e) an elongate magazine having a foot end and a dispensing end, and being configured 1) to define an interior magazine chamber capable of receiving therein a plurality of BB pellets, with the magazine chamber having a dispensing passage located near the dispensing end of the magazine, 2) to be insertable dispensing-end-first into the magazine passage to a fully inserted position wherein the dispensing end of the magazine is positioned near to but spaced from the thin bottom wall portion of the breech end region of the barrel, 3) to define exit door means for normally closing the dispensing passage to retain BB pellets within the magazine chamber, and for moving to an open position when the magazine is moved into the fully inserted position, and 4) to define follower means within the magazine chamber a) for biasing BB pellets in the magazine chamber along the dispensing passage toward the door, and b) for biasing a BB pellet that passes at least partially out of the dispensing passage when the door is opened into engagement with the thin bottom wall portion of the breech end region of the projectile passage at the loading station so that, when the loading port of the projectile moves through the loading station in response to forward movement of the barrel due to operation of the trigger means, the BB pellet that has been biased into engagement with the thin bottom wall portion of the breech end region of the barrel will be caused to move through the loading port into the projectile passage for being contained therein briefly until being fired through the projectile passage for discharge from the muzzle end region of the barrel in response to said burst of pressurized gas being dispensed into the breech end region of the projectile passage when the rearwardly-biased barrel is released by the trigger means and moves rearwardly to impact and move the movable valve member a short distance rearwardly.

2. The gas-powered gun of claim 1 additionally including magnetic means for aiding in positioning an iron-containing BB pellet that has moved through the loading port into the projectile passage until said BB pellet is fired through the projectile passage by a burst of pressurized gas.

3. The gas-powered gun of claim 2 wherein the magnetic means includes a magnet carried by the movable valve member for attracting said iron-containing BB pellet toward the movable valve member.

4. The gas-powered gun of claim 3 wherein the movable valve member 1) is of elongate configuration having a tubular front end region through which bursts of gas dispensed by the valve means are ducted into the breech end region of the projectile passage, 2) has a rear end region spaced rearwardly from said tubular front end region, 3) is made of ferrous material that is capable of being magnetized, and 4) has the magnet connected to said rear end region to thereby magnetize the movable valve member to attract said BB pellet toward the tubular front end region of the movable valve member.

5. The gas-powered gun of claim 1 additionally including a metal fitting machined 1) to define the rear end region of the barrel passage, 2) to define a portion of the gas supply passage that communicates with the rear end region of the barrel passage, and 3) to support the valve means in the rear end region of the barrel passage; and wherein the machined metal fitting has exterior surface portions that are closely enveloped by die-cast metal that defines other portions of the frame means.

6. The gas-powered gun of claim 5 wherein the metal fitting has an internally threaded region defined along said portion of the gas supply passage, and puncturing means is supported in the internally threaded region for puncturing a sealed end region of a cylinder of compressed gas carried in the central portion of the gas supply passage and for ducting pressurized gas from the cylinder into said portion of the gas supply passage.

7. The gas-powered gun of claim 5 wherein the metal fitting has an internally threaded region, the valve means includes a generally tubular outer member having external threads that are threaded into the internally threaded region, and the outer member has an inner passage formed therethrough that slidably engages exterior surface portions of the movable valve member to slidably support the movable valve member.

8. The gas-powered gun of claim 7 wherein the "outer valve member" and the movable valve member define opposed valving surfaces that are relatively movable between a spaced-apart open position and a sealingly engaged closed position, with these valving surfaces being normally biased toward their closed position to retain pressurized gas within the rear end region of the barrel passage, but being moved to their open position when the movable valve member is briefly moved rearwardly as the result of being impacted by the rearwardly moving barrel.

9. The gas-powered gun of claim 7 wherein the tubular outer member defines a forward end surface spaced rearwardly from the loading station that is configured to be engaged by the dispensing end of the magazine when the magazine is fully inserted in the magazine passage.

10. The gas-powered gun of claim 9 wherein the magazine is formed principally from plastic material and additionally includes a metal wear plate supported by the plastic material at the dispensing end of the magazine, with the metal wear plate being oriented to engage the forward end surface of the tubular outer member when the magazine is fully inserted in the magazine passage.

11. The gas-powered gun of claim 1 additionally including latch means for engaging the foot end of the magazine when the magazine is fully inserted into the magazine passage to releasably retain the magazine fully inserted in the magazine passage.

12. The gas-powered gun of claim 11 wherein a notch is formed in the foot end of the magazine, and the latch means includes a spring-biased pawl that is carried by the frame means for extending into the notch when the magazine is fully inserted in the magazine passage.

13. The gas-powered gun of claim 11 wherein the magazine has an elongate main body that defines the magazine chamber and the dispensing passage, the foot end of the magazine is movably connected to the main body for movement toward and away from the main body between an extended position and a retracted position in directions that generally parallel the length of the elongate main body, and the latch is operable to latchingly engage the foot end of the magazine only when the foot end is in the retracted position.

14. The gas-powered gun of claim 13 additionally including spring means interposed between the main body and the foot end of the magazine for biasing the foot end away from the main body toward the extended position, with the foot end of the magazine being configured to be sufficiently loosely received within the magazine passage that, when the latch is released, the foot end will move to its extended position to provide structure that can be easily grasped in withdrawing the main body of the magazine from the magazine passage.

15. The gas-powered gun of claim 14 wherein the foot end is connected to the main body by pin-and-slot connection means that includes a pair of spaced pins carried by the main body and slots formed in the foot end that engage the pins, with the length of the slots determining the distance through which the foot end can move toward and away from the main body.

16. The gas-powered gun of claim 1 additionally including safety means carried by the frame means for movement between a safety-on position wherein the safety means blocks reciprocation of the barrel, and a safety-off position wherein the safety means does not obstruct reciprocation of the barrel.

17. The gas-powered gun of claim 16 wherein the safety means is an elongate, generally cylindrical member that has opposite end regions movably carried in a pair of spaced, aligned, transversely extending openings defined by the frame means, and that has a central portion located along a path followed by a selected portion of the hammer mass of the barrel when the barrel reciprocates, with the central portion having a relatively large diameter portion that is positioned in said path to be engaged by the selected portion so as to obstruct barrel reciprocation when the safety means is in the safety-on position, and having a relatively small diameter portion that is positioned to not be engaged by the selected portion so as to not obstruct barrel reciprocation when the safety means is in the safety-off position.

18. The gas-powered gun of claim 17 wherein the selected portion of the hammer mass includes a projecting tab formation defined by the hammer mass.

19. The gas-powered gun of claim 1 wherein the trigger means includes a trigger carriage that is connected to the frame means, a trigger lever that is pivotally connected to the trigger carriage for movement between operated and non-operated positions, a sear lever that is pivotally connected to the trigger lever, and return spring means interposed between the trigger carriage and the sear lever for biasing the trigger lever and the sear to move the trigger lever toward the non-operated position.

20. The gas-powered gun of claim 19 additionally including safety means carried by the frame means for movement between a safety-on position wherein the safety means blocks reciprocation of the barrel, and a safety-off position wherein the safety means does not obstruct reciprocation of the barrel, and wherein detent means is carried by the trigger carriage for engaging the safety means to releasably retain the safety means in the safety-on and safety-off positions.

21. The gas-powered gun of claim 20 wherein the safety means includes an elongate, generally cylindrical member that has its opposite ends supported in spaced, aligned, transversely extending holes defined by the frame means, and the trigger carriage has a portion that extends alongside a central part of the generally cylindrical member for carrying a spring-biased detent that is engageable with the central part to releasably retain the elongate member in the safety-on and safety-off positions.

22. The gas-powered gun of claim 19 wherein the sear lever has a pair of spaced arms configured to engage spaced portions of the hammer mass that are located symmetrically on opposite sides of the projectile passage to thereby transfer force in a balanced way from the trigger lever to the barrel means.

23. The gas-powered gun of claim 22 wherein the hammer mass has a rearwardly extending portion that defines the spaced portions of the hammer mass, and the arms of the sear lever are configured to pivot beneath the spaced portions of the hammer mass when the trigger has been operated sufficiently to move the barrel to a forward position wherein the barrel is to be released for rearward movement to impact the movable valve member.

24. The gas-powered gun of claim 22 wherein the magazine is configured so that, when it is fully inserted into the magazine passage, the dispensing end of the magazine is spaced from the thin bottom wall of the breech end region of the barrel by a distance that is not greater than one-fourth the diameter of BB pellets that are carried in the magazine chamber.

25. The gas-powered gun of claim 22 wherein the magazine has a generally rectangular cross-section and the foot of the magazine carries a generally rectangular cover portion for closing the magazine passage when the magazine is fully inserted into the magazine passage.

26. The gas-powered gun of claim 22 wherein the magazine has an elongate slot extending along a majority of its length to provide a view into the magazine chamber of the magazine so that portions of selected BB pellets contained therein can be viewed, with the slot not having a width great enough to permit BB pellets contained within the magazine chamber to escape.

27. The gas-powered gun of claim 26 wherein the slot has an enlargement located along its length that is normally closed by the follower means, and that can be used to load BB pellets into the magazine chamber when the follower means is moved to a loading position within the magazine chamber located toward an end of the magazine chamber opposite from where the door is located.

28. The gas-powered gun of claim 27 wherein the slot has a transversely extending branch located near where the follower means when the follower means is moved to the loading position, and the follower carries a flag projection that extends into the slot and that is movable into the transverse branch to releasably retain the follower in the loading position.

29. The gas-powered gun of claim 28 wherein the follower has a body that is biased toward a position of engagement with BB pellets carried in the magazine chamber, and the flag projection is pivotally connected to the body for movement about an axis that generally parallels the length of the slot.

30. The gas-powered gun of claim 19 wherein the trigger carriage defines a formation that engages the exit door of the magazine during final movement of the magazine into its fully inserted position in the magazine passage to move the door to the open position.

31. A gas-powered gun comprising: a frame having a grip thereon; a projectile barrel slidably mounted in said frame and axially reciprocal between a forward position and a rearward position therein, said barrel having a breech end, a muzzle end, a hammer mass connected to the barrel for reciprocal movement with the barrel and disposed between the breech end and the muzzle end, a projectile passage extending through the barrel from the breech end to the muzzle, and a loading port formed through a side of the barrel facing toward the grip at a location spaced a short distance forwardly from the breech end of the barrel for admitting a BB pellet into the projectile passage; a valve chamber defined adjacent the breech end of the barrel; a gas passage defined in the grip, communicating with the valve chamber, configured to receive a compressed gas cylinder therein, and having puncturing means disposed therein for puncturing a sealed end region of a compressed gas cylinder to supply pressurized gas to the valve chamber; valve means disposed in the valve chamber including a movable valve member that is reciprocal between a closed position toward the barrel and an open position in the opposite direction, with the movable valve member defining a forwardly facing engagement surface and being configured to duct pressurized gas into the breech end of the projectile passage when in the open position; a firing spring disposed around the barrel and biasing the barrel rearwardly toward a position wherein the breech end of the barrel engages the engagement surface of the movable valve member; a valve spring disposed in the valve chamber, biasing the movable valve member toward the closed position, and opposing the action of the firing spring when the breech end of the barrel is in engagement with the engagement surface; trigger means to reciprocate the barrel to the forward position and then to automatically release the barrel for return reciprocation so that the breech end of the barrel will impact the engagement surface with sufficient momentum to move the movable valve member to the open position, with the valve spring and the pressure of the gas in the valve chamber being quickly operable to dissipate said momentum and to return the movable valve member to the closed position so that only a burst of pressurized gas is ducted into the breech end of the projectile passage in response to impact of the barrel with the engagement surface; and, magazine means also disposed in the grip and extending into closely spaced relationship with the barrel at a location just forward of the valve means for defining a loading station and for feeding BB pellets one at a time to the loading station and into the projectile passage of the barrel through the loading port of the barrel as the loading port moves through the loading station during forward movement of the barrel by the trigger means and just prior to the barrel's being released by the trigger means for return reciprocation.

32. The gas-powered gun of claim 31 additionally including magnetic means for aiding in positioning an iron-containing BB pellet that has moved through the loading port into the projectile passage until said BB pellet is fired through the projectile passage by a burst of pressurized gas ducted into the breech end of the projectile passage by the valve means when the engagement surface is impacted by the breech end of the barrel.

33. The gas-powered gun of claim 32 wherein the magnetic means includes a magnet carried by the movable valve member for attracting said iron-containing BB pellet toward the movable valve member.

34. The gas-powered gun of claim 33 wherein the movable valve member 1) is of elongate configuration having a tubular front end region through which bursts of gas are ducted into the breech end region of the projectile passage, 2) has a rear end region spaced rearwardly from said tubular front end region, 3) is made of ferrous material that is capable of being magnetized, and 4) has the magnet connected to said rear end region to thereby magnetize the movable valve member to attract said BB pellet toward the tubular front end region of the movable valve member.

35. The gas-powered gun of claim 31 additionally including a metal fitting machined 1) to define the valve chamber, 2) to define a portion of the gas supply passage that communicates with the valve chamber, and 3) to support the valve means; and wherein the machined metal fitting has exterior surface portions that are closely enveloped by die-cast metal that defines other portions of the frame.

36. The gas-powered gun of claim 35 wherein the metal fitting has an internally threaded region, the valve means includes a generally tubular outer member having external threads that are threaded into the internally threaded region, and the outer member has an inner passage formed therethrough that slidably engages exterior surface portions of the movable valve member to slidably support the movable valve member.

37. The gas-powered gun of claim 36 wherein the outer valve member and the movable valve member define opposed valving surfaces that are relatively movable between a spaced-apart open position and a sealingly engaged closed position, with these valving surfaces being normally biased toward their closed position by the valve spring but being moved to their open position when the movable valve member is briefly moved rearwardly as the result of the engagement surface being impacted by the breech end of the rearwardly moving barrel.

38. The gas-powered gun of claim 36 wherein the magazine means is carried in a magazine passage defined by the grip and is removable therefrom so that BB pellets can be loaded into a magazine chamber defined by the magazine means.

39. The gas-powered gun of claim 38 wherein the tubular outer member defines a forward end surface spaced rearwardly from the loading station that is engaged by the magazine means when the magazine means is fully inserted into the magazine passage.

40. The gas-powered gun of claim 39 wherein the magazine means is formed principally from plastic material and additionally includes a metal wear plate supported by the plastic material for engaging the forward end surface of the tubular outer member when the magazine means is fully inserted in the magazine passage.

41. The gas-powered gun of claim 38 additionally including latch means for releasably retaining the magazine means fully inserted into the magazine passage.

42. The gas-powered gun of claim 31 additionally including safety means carried by the frame for movement between a safety-on position wherein the safety means blocks reciprocation of the barrel, and a safety-off position wherein the safety means does not obstruct reciprocation of the barrel.

43. The gas-powered gun of claim 42 wherein the safety means is an elongate, generally cylindrical member that has opposite end regions movably carried in a pair of spaced, aligned, transversely extending openings defined by the frame, and that has a central portion located along a path followed by a selected portion of the hammer mass of the barrel when the barrel reciprocates, with the central portion having a relatively large diameter portion that is positioned in said path to be engaged by the selected portion so as to obstruct barrel reciprocation when the safety means is in the safety-on position, and having a relatively small diameter portion that is positioned to not be engaged by the selected portion so as to not obstruct barrel reciprocation when the safety means is in the safety-off position.

44. The gas-powered gun of claim 31 wherein the trigger means includes a trigger carriage that is connected to the frame, a trigger lever that is pivotally connected to the trigger carriage for movement between operated and non-operated positions, a sear lever that is pivotally connected to the trigger lever, and return spring means interposed between the trigger carriage and the sear lever for biasing the trigger lever and the sear to move the trigger lever toward the non-operated position.

45. The gas-powered gun of claim 44 additionally including safety means carried by the frame for movement between a safety-on position wherein the safety means blocks reciprocation of the barrel, and a safety-off position wherein the safety means does not obstruct reciprocation of the barrel, and wherein detent means is carried by the trigger carriage for engaging the safety means to releasably retain the safety means in the safety-on and safety-off positions.

46. The gas-powered gun of claim 44 wherein the sear lever has a pair of spaced arms configured to engage spaced portions of the hammer mass that are located symmetrically on opposite sides of the projectile passage to thereby transfer force in a balanced way from the trigger lever to the barrel means.

47. The gas-powered gun of claim 46 wherein the hammer mass has a rearwardly extending portion that defines the spaced portions of the hammer mass, and the arms of the sear lever are configured to pivot beneath the spaced portions of the hammer mass when the trigger has been operated sufficiently to move the barrel to a forward position.

48. The gas-powered gun of claim 31 wherein the magazine means includes an elongate magazine that has a dispensing end and a foot end, that is insertable into a magazine passage defined by the grip to a fully inserted position wherein the dispensing end of the magazine is positioned adjacent the loading station, and that is configured 1) to define an interior magazine chamber capable of receiving therein a plurality of BB pellets, with the magazine chamber having a dispensing passage located near the dispensing end of the magazine, 2) to define exit door means for normally closing the dispensing passage to retain BB pellets within the magazine chamber, and for moving to an open position when the magazine is moved into the fully inserted position, and 3) to define follower means within the magazine chamber a) for biasing BB pellets in the magazine chamber along the dispensing passage toward the door, and b) for biasing a BB pellet that moves at least partially out of the dispensing passage when the door is opened into engagement with an outer surface of a breech end region of the barrel so that, when the loading port of the projectile moves through the loading station in response to forward movement of the barrel due to operation of the trigger means, the BB pellet that has been biased into engagement with the outer surface of the breech end region of the barrel will be caused to move through the loading port into the projectile passage for being contained therein briefly until being fired through the projectile passage for discharge from the muzzle end region of the barrel in response to a burst of pressurized gas being ducted into the breech end region of the projectile passage when the barrel is released by the trigger means and moves rearwardly to impact the engagement surface to rearwardly move the movable valve member.

49. The gas-powered gun of claim 48 wherein the magazine has a generally rectangular cross-section and the foot of the magazine carries a generally rectangular cover portion for closing the magazine passage when the magazine is fully inserted into the magazine passage.

50. The gas-powered gun of claim 48 wherein the magazine has an elongate slot extending along a majority of its length to provide a view into the magazine chamber of the magazine so that portions of selected BB pellets contained therein can be viewed, with the slot not having a width great enough to permit BB pellets contained within the magazine chamber to escape, but with the slot having an enlargement located along its length that is normally closed by the follower means, and that can be used to load BB pellets into the magazine chamber when the follower means is moved to a loading position within the magazine chamber located toward an end of the magazine chamber opposite from where the door is located.

51. A gas-powered gun having a metal frame that forms a barrel portion and a grip portion of the gun, with a pre-machined fitting having exterior surfaces enveloped by the metal of the frame during die-casting of the frame, with the fitting being located at a juncture of an elongate, forwardly-opening barrel passage formed through the barrel portion during die-casting of the frame and a gas supply passage formed through the grip portion during die-casting of the frame, with a magazine passage that extends side-by-side with the gas supply passage also being formed during die-casting of the frame, with a reciprocally movable barrel carried in the barrel passage and slidably connected to the frame, with valve means being carried by the fitting for ducting a burst of compressed gas from the gas supply passage into a breech end region of the barrel in response to rearward movement of the barrel under the influence of a firing spring that is interposed between the barrel and the frame for biasing the barrel rearwardly toward the fitting, with magazine means being insertable into the magazine passage to supply projectiles one at a time through a loading port formed in the barrel near the breech end of the barrel, and with trigger means for moving the barrel forwardly in the barrel passage to a position wherein the barrel is released to move rearwardly under the influence of the firing spring to cause the valve means to duct said burst of compressed gas into the breech end region of the barrel to propel a projectile through the barrel for discharge from a muzzle end region of the barrel.

52. The gas-powered gun of claim 51 wherein the valve means has member that extends into the breech end region of the barrel and that employs magnetic force to attract an iron-containing projectile that has been fed into the barrel through the loading port to aid in positioning the projectile to receive a burst of compressed gas to be propelled thereby from the muzzle end region of the barrel.

53. The gas-powered gun of claim 51 wherein the gas passage of the barrel has an end region that is defined by a sleeve that has machined internal threads formed at a time before the frame of the gun was die-cast, with external surface portions of the sleeve being enveloped during the die-casting of the frame to connect the sleeve to the metal of the frame.

54. The gas-powered gun of claim 51 wherein the trigger means includes a trigger assembly having a trigger carriage on which a trigger lever is pivotally mounted, a sear lever that is pivotally mounted on the trigger lever, and a return spring connected to the trigger carriage and to the sear, with the sear lever being configured to engage a rearwardly-facing surface of the hammer mass to move the barrel forwardly, and being configured to thereafter disengage from the rearwardly-facing surface of the hammer mass to release the barrel for moving rearwardly under the influence of the firing spring, with the trigger assembly being pre-assembled and connected as a unit to the metal of the die-cast frame at a time after the die-casting of the frame has been completed.

55. A gas-powered pistol, comprising:

a) a frame having an elongate body that defines an elongate barrel passage, and having a grip that defines an elongate gas passage having one end region that communicates with one end region of the barrel passage at a juncture of the body and the grip, with the grip also defining an elongate magazine passage that extends generally parallel to the gas passage and has one end region that communicates with the barrel passage, and with the frame defining a trigger opening through which access is provided to the barrel passage at a location spaced forwardly along the barrel passage from said juncture;

b) valve housing means connected to the frame for defining a valve passage at said juncture, with the valve passage having a first elongate branch that extends along an imaginary barrel axis that extends substantially centrally through the elongate barrel passage, and having a second elongate branch that communicates with the first elongate portion and that extends along an imaginary gas passage axis that extends substantially centrally through the elongate gas passage;

c) valve assembly means connected to the valve housing means and communicating with the first branch for receiving pressurized gas introduced into the valve housing means through the second branch when a pressurized gas cylinder is installed in the elongate gas passage, and for providing a movable valve member that is biased toward a closed position and is capable of being cycled rapidly from the closed position to an open position and thence back to the closed position in response to being impacted, to thereby discharge a burst of pressurized gas from the first branch into the barrel passage;

d) spring-biased barrel means including an elongate tubular projectile barrel having a muzzle end and a breech end and a projectile passage extending therethrough from the muzzle end to the breech end for being connected to the frame for movement along the barrel axis between a forward position and a rearward position, for being biased away from the forward position toward the rearward position, and for normally assuming an at-rest position situated slightly forwardly from the rearward position, with the breech end of the barrel being configured to impact the movable valve member when the barrel is moved from the at-rest position to the forward position and then is released to move rearwardly from the forward position whereby the movable valve member is impacted and caused to be cycled from its closed to its open to its closed position to duct said burst of pressurized gas into the breech end of the projectile passage, and for defining a loading port located relatively near the breech end of the barrel that is configured to permit a BB pellet to pass therethrough into the projectile passage at a loading station when the loading port of the barrel is moved through the loading station as the barrel is moved forwardly from the at-rest position to the forward position;

e) magazine means configured to be inserted into the magazine passage for containing a supply of BB pellets, for feeding BB pellets one at a time to the loading station, and for biasing each BB pellet that has been fed to the loading station in a direction that will cause each BB pellet that has been fed to the loading station to be moved through the loading port so that, each time the barrel is moved to its forward position, a BB pellet then positioned at the loading station is fed through the loading port and into the barrel passage; and, f) trigger means connected to the frame and extending through the trigger opening for defining a finger operated trigger that is movable between operated and non-operated positions, that is biased toward its non-operated position, and that is operable, when moved from its non-operated position to its operated position to move the barrel from its at-rest position to its forward position and thence to release the barrel for movement to its rearward position so that a projectile that is loaded through the loading port into the projectile passage at the loading station is propelled through and discharged from the projectile passage by being acted upon by said burst of pressurized gas that is introduced into the breech end of the projectile passage when the breech end of the barrel impacts the movable valve member and is caused to be cycled from its closed to its open to its closed positions.

56. The gas-powered gun of claim 55 additionally including magnetic means for aiding in positioning an iron-containing BB pellet that has moved through the loading port into the projectile passage until said BB pellet is fired through the projectile passage by a burst of pressurized gas ducted into the breech end of the projectile passage.

57. The gas-powered gun of claim 56 wherein the magnetic means includes a magnet carried by the movable valve member for attracting said iron-containing BB pellet toward the movable valve member.

58. The gas-powered gun of claim 55 wherein the valve housing means is a metal fitting machined to define the first and second branches, with the machined metal fitting having exterior surfaces that are closely surrounded by die-cast metal that defines other portions of the frame.

59. The gas-powered gun of claim 58 wherein the metal fitting has an internally threaded region, the valve means includes a generally tubular outer member having external threads that are threaded into the internally threaded region, and the outer member has an inner passage formed therethrough that slidably engages exterior surface portions of the movable valve member to slidably support the movable valve member.

60. The gas-powered gun of claim 59 wherein the outer valve member and the movable valve member define opposed valving surfaces that are relatively movable between a spaced-apart open position and a sealingly engaged closed position, with these valving surfaces being normally biased toward their closed position.

61. The gas-powered gun of claim 55 additionally including latch means for releasably retaining the magazine means fully inserted into the magazine passage.

62. The gas-powered gun of claim 55 additionally including safety means carried by the frame for movement between a safety-on position wherein the safety means blocks reciprocation of the barrel, and a safety-off position wherein the safety means does not obstruct reciprocation of the barrel.

63. The gas-powered gun of claim 62 wherein the safety means is an elongate, generally cylindrical member that has opposite end regions movably carried in a pair of spaced, aligned, transversely extending openings defined by the frame, and that has a central portion located along a path followed by a selected portion of the hammer mass of the barrel when the barrel reciprocates, with the central portion having a relatively large diameter portion that is positioned in said path to be engaged by the selected portion of the barrel to obstruct barrel reciprocation when the safety means is in the safety-on position, and having a relatively small diameter portion that is positioned to not be engaged by the selected portion so as to not obstruct barrel reciprocation when the safety means is in the safety-off position.

64. The gas-powered gun of claim 55 wherein the trigger means includes a trigger carriage that is connected to the frame and that pivotally mounts the finger-operated trigger for movement between the operated and non-operated positions, a sear lever that is pivotally connected to the trigger lever, and return spring means interposed between the trigger carriage and the sear lever for biasing the trigger lever and the sear to move the trigger lever toward the non-operated position.

65. The gas-powered gun of claim 64 additionally including safety means carried by the frame for movement between a safety-on position wherein the safety means blocks reciprocation of the barrel, and a safety-off position wherein the safety means does not obstruct reciprocation of the barrel, and wherein detent means is carried by the trigger carriage for engaging the safety means to releasably retain the safety means in the safety-on and safety-off positions.

66. The gas-powered gun of claim 64 wherein the sear lever has a pair of spaced arms configured to engage spaced portions of the barrel that are located symmetrically on opposite sides of the projectile passage to thereby transfer force in a balanced way from the trigger to the barrel.

67. The gas-powered gun of claim 66 wherein the barrel has a rearwardly extending portion that defines said spaced portions, and the arms of the sear lever are configured to pivot beneath said spaced portions when the trigger has been operated sufficiently to move the barrel to the forward position.

* * * * *